US008940465B2

(12) United States Patent
Sekido et al.

(10) Patent No.: US 8,940,465 B2
(45) Date of Patent: Jan. 27, 2015

(54) ELECTROPHOTOGRAPHIC PHOTOSENSITIVE MEMBER, METHOD FOR PRODUCING ELECTROPHOTOGRAPHIC PHOTOSENSITIVE MEMBER, PROCESS CARTRIDGE, ELECTROPHOTOGRAPHIC APPARATUS, AND IMIDE COMPOUND

(71) Applicant: Canon Kabushiki Kaisha, Tokyo (JP)

(72) Inventors: Kunihiko Sekido, Suntou-gun (JP); Hiroyuki Tomono, Numazu (JP); Michiyo Sekiya, Atami (JP); Atsushi Okuda, Yokohama (JP); Yuka Ishiduka, Suntou-gun (JP); Nobuhiro Nakamura, Mishima (JP); Yota Ito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/930,869

(22) Filed: Jun. 28, 2013

(65) Prior Publication Data

US 2014/0004455 A1 Jan. 2, 2014

(30) Foreign Application Priority Data

Jun. 29, 2012 (JP) ..... 2012-147156
Apr. 25, 2013 (JP) ..... 2013-093091
May 28, 2013 (JP) ..... 2013-112111

(51) Int. Cl.
*G03G 5/14* (2006.01)
*G03G 15/00* (2006.01)
*G03G 5/05* (2006.01)
(Continued)

(52) U.S. Cl.
CPC ..... *G03G 15/751* (2013.01); *G03G 5/0525* (2013.01); *G03G 5/0592* (2013.01); *G03G 5/0607* (2013.01); *G03G 5/0648* (2013.01); *G03G 5/065* (2013.01); *G03G 5/0651* (2013.01); *G03G 5/075* (2013.01); *G03G 5/076* (2013.01); *G03G 5/142* (2013.01); *G03G 15/00* (2013.01)
USPC ..... 430/60; 430/62; 427/74; 546/66

(58) Field of Classification Search
USPC ..... 430/60, 62; 427/74; 546/66
See application file for complete search history.

(56) References Cited

U.S. PATENT DOCUMENTS 4,442,193 A 4/1984 Chen
4,562,132 A 12/1985 Ong et al.
4,992,349 A 2/1991 Chen
(Continued)

FOREIGN PATENT DOCUMENTS

EP 1542082 A1 6/2005
EP 2033961 A1 3/2009
(Continued)

OTHER PUBLICATIONS

"Nitration of Phenanthraquinone", partial translation, vol. 15, pp. 29-34.
(Continued)

*Primary Examiner* — Peter Vajda
(74) *Attorney, Agent, or Firm* — Canon U.S.A., Inc. IP Division

(57) ABSTRACT

An undercoat layer of an electrophotographic photosensitive member contains a polymerized product of a composition that contains an isocyanate compound having a specific structure, a resin having a specific structure, and an electron transporting substance having a specific structure.

12 Claims, 3 Drawing Sheets

(51) Int. Cl.

| | |
|---|---|
| ***G03G 5/06*** | (2006.01) |
| ***G03G 5/07*** | (2006.01) |

(56) References Cited

U.S. PATENT DOCUMENTS

| | | | |
|---|---|---|---|
| 5,468,583 | A | 11/1995 | Gruenbaum |
| 5,747,206 | A | 5/1998 | Agata et al. |
| 5,795,690 | A | 8/1998 | Takegawa |
| 7,670,740 | B2 | 3/2010 | Wu et al. |
| 7,781,132 | B2 | 8/2010 | Yanus et al. |
| 2004/0166427 | A1 | 8/2004 | Tong |
| 2006/0281020 | A1 | 12/2006 | Kim et al. |
| 2007/0026332 | A1 | 2/2007 | Ferrar et al. |
| 2007/0059619 | A1 | 3/2007 | Shimoyama |
| 2011/0318675 | A1 | 12/2011 | Yu |
| 2012/0064442 | A1 | 3/2012 | Kawabata |
| 2014/0011127 | A1 | 1/2014 | Nakamura et al. |

FOREIGN PATENT DOCUMENTS

| | | | |
|---|---|---|---|
| EP | 2107424 | A1 | 10/2009 |
| EP | 2180376 | A2 | 4/2010 |
| JP | 1-206349 | A | 8/1989 |
| JP | 5-279582 | A | 10/1993 |
| JP | 7-70038 | A | 3/1995 |
| JP | 09-127716 | A | 5/1997 |
| JP | 9-151157 | A | 6/1997 |
| JP | 2001-83726 | A | 3/2001 |
| JP | 2003-330209 | A | 11/2003 |
| JP | 2003-345044 | A | 12/2003 |
| JP | 2004093801 | A | 3/2004 |
| JP | 2006-178504 | A | 7/2006 |
| JP | 2007-148293 | A | 6/2007 |
| JP | 2008-65173 | A | 3/2008 |
| JP | 2008-250082 | A | 10/2008 |
| JP | 2008-299344 | A | 12/2008 |
| JP | 2009-505156 | A | 2/2009 |

OTHER PUBLICATIONS

Brooks A. Jones et al., "Cyanonaphthalene Diimide Semiconductors for Air-Stable, Flexible, and Optically Transparent n-Channel Field-Effect Transistors", Chemistry of Materials,vol. 19,No. 11,2703-2705(2007).

Hiroyuki Miyamura et al., "Polymer Incarcerated Gold Catalyzed Aerobic Oxidation of Hydroquinones and their Derivatives", Chemistry Letters, 37(3),360-361(2008).

Brooks A. Jones, et al., "Tuning Orbital Energetics in Arylene Diinlide Semiconductors, Materials Design for Ambient Stability of n-Type Charge Transport", Journal of the American chemical society,vol. 129,No. 49,15259-78 (2007).

Hideki Okada, et al., Synthesis and Properties of a Novel Electron Transporting Compound, 3,3'-dialkyl-4,4'-bisnaphthylquinone (DBNQ), PPCI Japan Hard Copy'98 p. 207, 1998.

Masaki Yamada, et al., "Synthesis and Properties of Diamino-Substituted Dipyrido [3,2-a: 2',3'-c]phenazine", Bull. Chem.Soc. Jpn.,vol. 65,1006-1011(1992).

Tetrahedron Letters,44(10),2087-2091(2003).

Tetrahedron Letters,43(16),2991-2994(2002).

Ronald Callahan, et al, "Syntheses of Phencyclone Analogues . . . ", Chem. Educator No. 6,227-234(2001).

ELECTROPHOTOGRAPHIC PHOTOSENSITIVE MEMBER, METHOD FOR PRODUCING ELECTROPHOTOGRAPHIC PHOTOSENSITIVE MEMBER, PROCESS CARTRIDGE, ELECTROPHOTOGRAPHIC APPARATUS, AND IMIDE COMPOUND

BACKGROUND OF THE INVENTION

1. Field of the Invention

The present invention relates to an electrophotographic photosensitive member, a method for producing an electrophotographic photosensitive member, a process cartridge and an electrophotographic apparatus that include the electrophotographic photosensitive member, and an imide compound.

2. Description of the Related Art

Currently, the mainstream electrophotographic photosensitive members mounted in process cartridges and electrophotographic apparatuses are those that contain organic photoconductive substances. Such electrophotographic photosensitive members have good film forming properties, can be produced by coating processes, and thus have an advantage of high production efficiency.

In general, an electrophotographic photosensitive member includes a support and a photosensitive layer on the support. In many cases, an undercoat layer is interposed between the support and the photosensitive layer to suppress charge injection from the support to the photosensitive layer side and occurrence of image defects such as black dots.

Charge generating substances contained in recent electrophotographic photosensitive members have increasingly high sensitivity.

However, as the sensitivity of the charge generating substances increases, the amount of charges generated is increased and charges tend to remain in the photosensitive layers, resulting in a problem called ghosting. In particular, a phenomenon called positive ghosting in which only the density of the portion irradiated with light during the previous rotation is increased in an output image readily occurs.

Japanese Patent Laid-Open Nos. 2001-83726 and 2003-345044 disclose techniques of suppressing (reducing) such a ghosting phenomenon by adding an electron transporting substance such as an imide compound to the undercoat layer.

In recent years, the quality requirements for the electrophotographic images have become more and more stringent and the permissible range for the positive ghosting has also narrowed.

The inventors have conducted investigations and found that the techniques disclosed in Japanese Patent Laid-Open Nos. 2001-83726 and 2003-345044 do not sufficiently suppress positive ghosting and further improvements are needed.

SUMMARY OF THE INVENTION

The present invention provides a electrophotographic photosensitive member that suppresses positive ghosting and a method for producing the electrophotographic photosensitive member. A process cartridge and an electrophotographic apparatus that include the electrophotographic photosensitive member are also provided. A novel imide compound that can suppress positive ghosting is also provided.

An aspect of the present invention provides an electrophotographic photosensitive member that includes a support, an undercoat layer formed on the support, and a photosensitive layer formed on the undercoat layer. The undercoat layer includes a polymerized product of a composition containing components (i) an isocyanate compound which has three to six groups selected from the group consisting of —NCO group and —NHCOX$^1$ group and has a molecular weight of 200 to 1300, the molecular weight being calculated without taking X$^1$ into account when the isocyanate compound has the —NHCOX$^1$ group, X$^1$ being a group represented by any one of formulae (1) to (7) below (1)

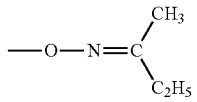

(2)

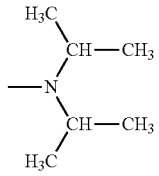

(3)

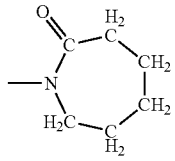

(4)

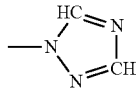

(5)

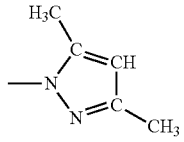

(6)

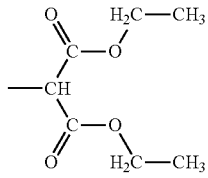

(7)

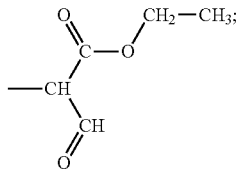

(ii) a resin having a repeating structural unit represented by formula (B) below (B)

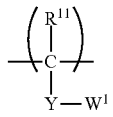

where R$^{11}$ represents a hydrogen atom or an alkyl group, Y represents a single bond or a phenylene group, and W$^1$ represents a hydroxy group, a thiol group, an amino group, or a carboxyl group; and (iii) at least one electron transporting substance selected from the group consisting of a compound represented by formula (A1) below, a compound represented by formula (A2) below, a compound represented by formula (A3) below, a compound represented by formula (A4) below, a compound represented by formula (A5) below, a compound represented by formula (A6) below, a compound represented by formula (A7) below, and a compound represented by formula (A8) below (A1)

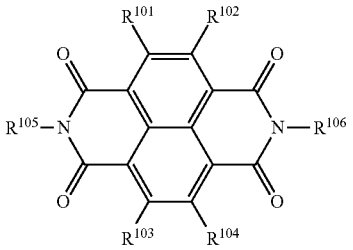

(A2)

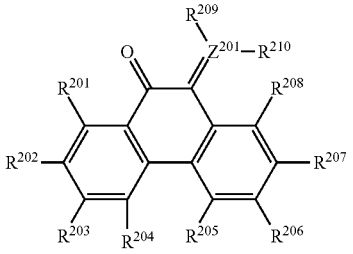

(A3)

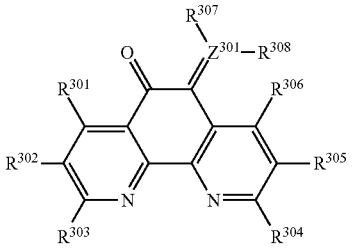

(A4)

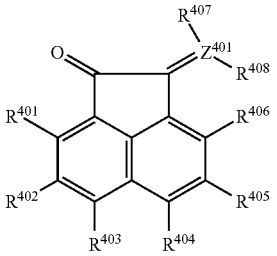

(A5)

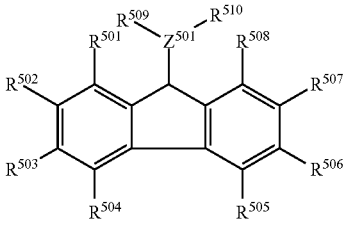

-continued (A6)

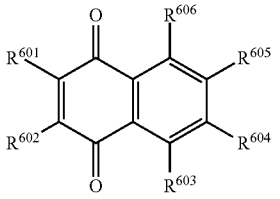

(A7)

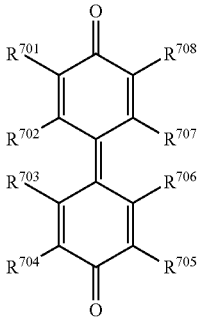

(A8)

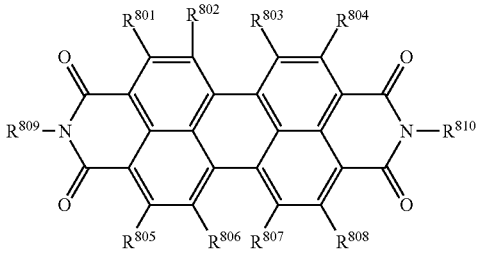

where $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, and $R^{801}$ to $R^{810}$ each independently represents a monovalent group represented by formula (A) below, a hydrogen atom, a cyano group, a nitro group, a halogen atom, an alkoxycarbonyl group, a substituted or unsubstituted alkyl group, a substituted or unsubstituted aryl group, or a substituted or unsubstituted heterocyclic group; at least one of the $R^{101}$ to $R^{106}$, at least one of the $R^{201}$ to $R^{210}$, at least one of the $R^{301}$ to $R^{308}$, at least one of the $R^{401}$ to $R^{408}$, at least one of the $R^{501}$ to $R^{510}$, at least one of the $R^{601}$ to $R^{606}$, at least one of the $R^{701}$ to $R^{708}$, and at least one of the $R^{801}$ to $R^{810}$ are each the monovalent group represented by formula (A) below; one of the carbon atoms in the alkyl group may be replaced with O, S, NH, or $NR^{901}$, $R^{901}$ representing an alkyl group; a substituent of the substituted alkyl group is a group selected from the group consisting of an alkyl group, an aryl group, an alkoxycarbonyl group, and a halogen atom; a substituent of the substituted aryl group is a group selected from the group consisting of a halogen atom, a nitro group, a cyano group, an alkyl group, and a halogen-substituted alkyl group; $Z^{201}$, $Z^{301}$, $Z^{401}$, and $Z^{501}$ each independently represents a carbon atom, a nitrogen atom, or an oxygen atom; $R^{209}$ and $R^{210}$ are absent when $Z^{201}$ is the oxygen atom; $R^{210}$ is absent when $Z^{201}$ is the nitrogen atom; $R^{307}$ and $R^{308}$ are absent when $Z^{301}$ is the oxygen atom; $R^{308}$ is absent when $Z^{301}$ is the nitrogen atom; $R^{407}$ and $R^{408}$ are absent when $Z^{401}$ is the oxygen atom; $R^{408}$ is absent when $Z^{401}$ is the nitrogen atom; $R^{509}$ and $R^{510}$ are absent when $Z^{501}$ is the oxygen atom; and $R^{510}$ is absent when $Z^{501}$ is the nitrogen atom, $$(\alpha)_l(\beta)_m\gamma \quad \text{(A)}$$

where at least one of α, β, and γ is a group having a substituent, the substituent being at least one group selected from the group consisting of a hydroxy group, a thiol group, an amino group, and a carboxyl group; l and m each independently represents 0 or 1; the sum of l and m is 0 to 2; α represents an alkylene group having 1 to 6 main-chain atoms, an alkylene group having 1 to 6 main-chain atoms and substituted with an alkyl group having 1 to 6 carbon atoms, an alkylene group having 1 to 6 main-chain atoms and substituted with a benzyl group, an alkylene group having 1 to 6 main-chain atoms and substituted with a alkoxycarbonyl group, or an alkylene group having 1 to 6 main-chain atoms and substituted with a phenyl group and may have at least one substituent selected from the group consisting of a hydroxy group, a thiol group, an amino group, and a carboxyl group; one of the carbon atoms in the main chain of the alkylene group may be replaced with O, S, NH, or $NR^{19}$, $R^{19}$ representing an alkyl group; β represents a phenylene group, a phenylene group substituted with an alkyl group having 1 to 6 carbon atoms, a phenylene group substituted with a nitro group, a phenylene group substituted with a halogen atom, or a phenylene group substituted with a alkoxy group and may have at least one substituent selected from the group consisting of a hydroxy group, a thiol group, an amino group, and a carboxyl group; and γ represents a hydrogen atom, an alkyl group having 1 to 6 main-chain atoms, or an alkyl group having 1 to 6 main-chain atoms and substituted with an alkyl group having 1 to 6 carbon atoms and may have at least one substituent selected from the group consisting of a hydroxy group, a thiol group, an amino group, and a carboxyl group. One of the carbon atoms in the main chain of the alkyl group may be replaced with $NR^{902}$ (where $R^{902}$ is an alkyl group).

Another aspect of the present invention provides a method for producing the electrophotographic photosensitive member. The method includes steps of forming a coating film by using a coating solution for forming an undercoat layer, the coating solution containing the composition, and heat-drying the coating film to form the undercoat layer.

Yet another aspect of the present invention provides a process cartridge detachably attachable to a main body of an electrophotographic apparatus. The process cartridge includes the electrophotographic photosensitive member and at least one device selected from the group consisting of a charging device, a developing device, a transferring device, and a cleaning device, in which the electrophotographic photosensitive member and the at least one device are integrally supported.

Yet another aspect of the present invention provides an electrophotographic apparatus that includes the electrophotographic photosensitive member, a charging device, an exposure device, a developing device, and a transferring device.

Still another aspect of the present invention provides imide compounds represented by formulae (21) to (24) below:

(21)

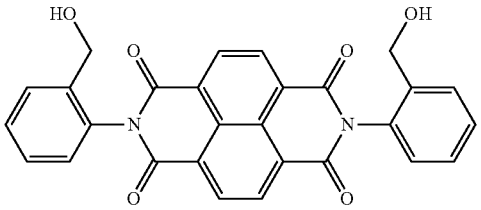

-continued (22)

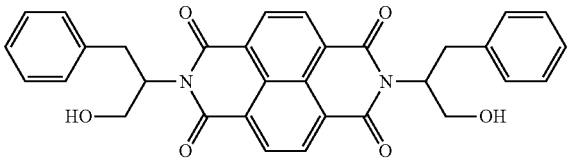

(23)

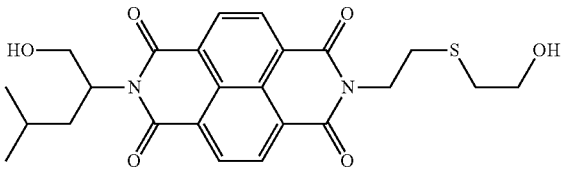

(24)

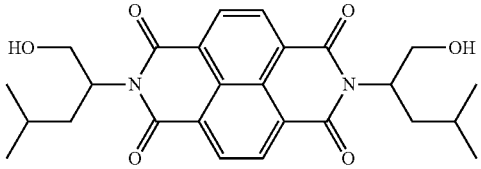

Further features of the present invention will become apparent from the following description of exemplary embodiments with reference to the attached drawings.

DESCRIPTION OF THE EMBODIMENTS

Figure 1:
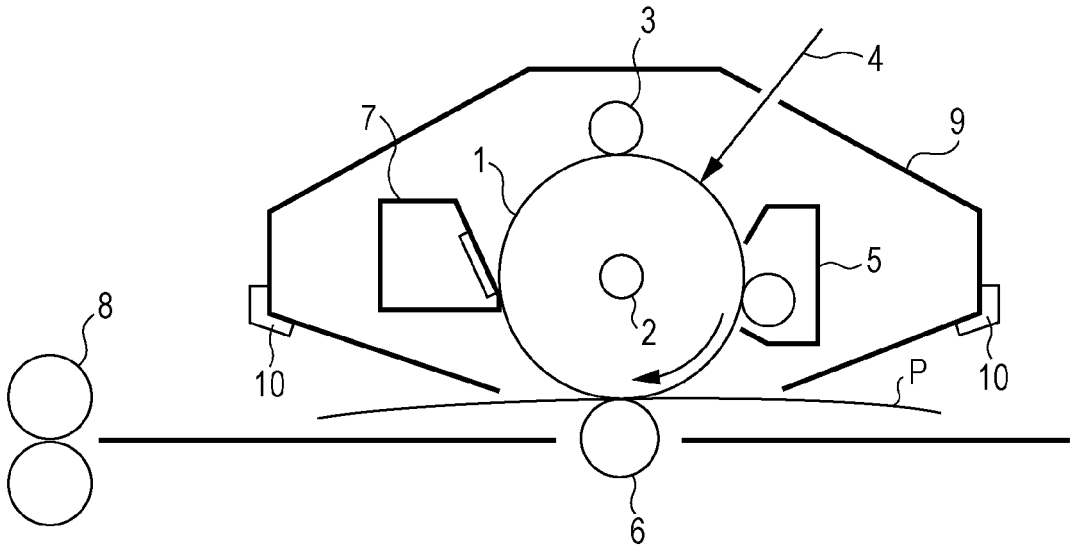
FIG. 1 is a schematic diagram of an electrophotographic apparatus that includes a process cartridge that includes an electrophotographic photosensitive member.

The inventors have made the following presumptions on the reason why an electrophotographic photosensitive member having an undercoat layer of the present invention achieves a superior effect of highly suppressing positive ghosting.

In the present invention, a polymerized product (cured material) is formed as a result of bonding between isocyanate groups of an isocyanate compound having a molecular weight of 200 to 1300 and three to six groups selected from the group consisting of —NCO groups (hereinafter may also be referred to as isocyanate groups) and —$NHCOX^1$ groups (hereinafter may also be referred to as blocked isocyanate groups), substituents of a compound (also referred to as an electron transporting substance) represented by any one of Formulae (A1) to (A8), and a substituent $W^1$ of a resin having a repeating structural unit represented by formula (B). An undercoat layer containing this polymerized product can transport electrons and becomes sparingly soluble in solvents.

However, an undercoat layer that contains a polymerized product prepared by polymerizing a composition constituted by several materials (isocyanate compound, electron transporting substance, and resin) tends to be inhomogeneous since materials having the same structure tend to aggregate. As a result, electrons tend to dwell in the undercoat layer or at the interface between the undercoat layer and the photosensitive layer and ghosting easily occurs. Because the isocyanate compound of the present invention contains three to six isocyanate groups and blocked isocyanate groups and the isocyanate groups are not adjacent to each other, the isocyanate compound is appropriately bulky and has a large volume. Accordingly, when the isocyanate groups and blocked isocyanate groups of the isocyanate compound are polymerized with a resin, the isocyanate compound presumably pushes the molecular chains of the resin and suppresses aggregation (localization) of the molecular chains of the resin. Since an electron transporting substance is bonded to the isocyanate compound bonded to the molecular chains of the resin whose localization is suppressed, the electron transporting substance also distributes evenly in the undercoat layer without localization. As a result, a polymerized product in which structures derived from the isocyanate compound, the electron transporting substance, and the resin are evenly distributed can be obtained, dwelling of electrons is significantly reduced, and a higher ghosting suppressing effect is achieved.

In a polymerized product obtained by polymerizing an isocyanate compound having a polymer chain with pendant isocyanate groups or by polymerizing a compound in which a segment having an electron transport ability is directly bonded to an isocyanate compound, aggregation of the structures derived from such compounds easily occurs and a sufficiently high effect of suppressing positive ghosting is not obtained. In the case where an isocyanate compound having two or less isocyanate groups is polymerized, the number of isocyanate groups contributing to polymerization is small. Thus, the isocyanate groups polymerized with the resin has a small effect of pushing the resin chains. Accordingly, the effect of suppressing localization of the electron transporting substance is decreased and a sufficiently high effect of suppressing ghosting is not obtained.

The electrophotographic photosensitive member of the present invention includes a support, an undercoat layer on the support, and a photosensitive layer on the undercoat layer. The photosensitive layer may be a layered (separated function) photosensitive layer constituted by a charge generating layer that contains a charge generating substance and a charge transporting layer that contains a charge transport substance. From the viewpoint of electrophotographic properties, the layered photosensitive layer may be a normal-order layered photosensitive layer that includes a charge generating layer and a charge transporting layer stacked in that order from the support side.

Figure 4A:
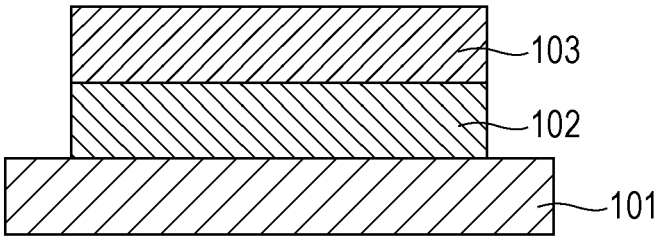
FIGS. 4A and 4B illustrate examples of the layer configuration of an electrophotographic photosensitive member.
Figure 4B:
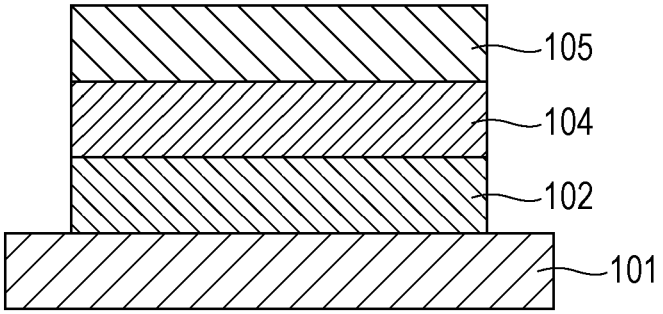

FIGS. 4A and 4B show examples of the layer configuration of electrophotographic photosensitive members. The electrophotographic photosensitive member shown in FIG. 4A includes a support 101, an undercoat layer 102, and a photosensitive layer 103. The electrophotographic photosensitive member shown in FIG. 4B includes a support 101, an undercoat layer 102, a charge generating layer 104, and a charge transporting layer 105.

A cylindrical electrophotographic photosensitive member including a cylindrical support and a photosensitive layer (electron generating layer and charge transporting layer) disposed on the support is widely used as a common electrophotographic photosensitive member. The electrophotographic photosensitive member may also have other shapes such as a belt shape and a sheet shape.

Support

The support may have electrical conductivity (conductive support). For example, the support may be composed of a metal such as aluminum, nickel, copper, gold, or iron or an alloy. Other examples of the support include those prepared by forming a thin film of a metal such as aluminum, silver, or gold, or a thin film of a conductive material such as indium oxide or tin oxide on an insulating support such as one composed of a polyester resin, a polycarbonate resin, a polyimide resin, or glass.

The surface of the support may be subjected to an electrochemical treatment such as anodizing, a wet horning treatment, a blasting treatment, or a cutting treatment to improve the electrical properties and suppress interference fringes.

A conductive layer may be interposed between the support and the undercoat layer described below. The conductive layer is obtained by forming a coating film on a support by using a coating solution containing a resin and conductive particles dispersed in the resin and drying the coating film. Examples of the conductive particles include carbon black, acetylene black, metal powders such as aluminum, nickel, iron, nichrome, copper, zinc, and silver powders, and metal oxide powders such as conductive tin oxide and indium tin oxide (ITO).

Examples of the resin include polyester resins, polycarbonate resins, polyvinyl butyral resins, acrylic resins, silicone resins, epoxy resins, melamine resins, urethane resins, phenolic resins, and alkyd resins.

Examples of the solvent used for preparing the coating solution for forming the conductive layer include ether-based solvents, alcohol-based solvents, ketone-based solvents, and aromatic hydrocarbon solvents. The thickness of the conductive layer is preferably 0.2 μm or more and 40 μm or less, more preferably 1 μm or more and 35 μm or less, and most preferably 5 μm or more and 30 μm or less.

Undercoat Layer

An undercoat layer is interposed between the support and the photosensitive layer or between the conductive layer and the photosensitive layer.

The undercoat layer contains a polymerized product of a composition that contains (i) the isocyanate compound described above, (ii) the resin described above, and (iii) the electron transporting substance described above.

The undercoat layer is formed by forming a coating film by using a coating solution that contains the composition comprising the isocyanate compound described above, a resin having a repeating structural unit represented by formula (B) below, and an electron transporting substance and drying the coating film by heating. After formation of the coating film, the compounds are polymerized (hardened) through chemical reactions. During this process, heating is conducted to accelerate the chemical reaction and polymerization.

Examples of the solvent used to prepare a coating solution for forming the undercoat layer include alcohol-based solvents, sulfoxide-based solvents, ketone-based solvents, ether-based solvents, ester-based solvents, and aromatic hydrocarbon solvents.

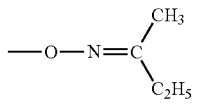

(1)

-continued
(2)
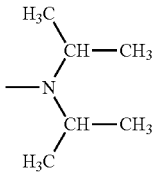
(3)
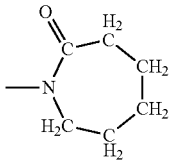
(4)
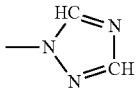
(5)
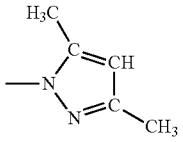
(6)
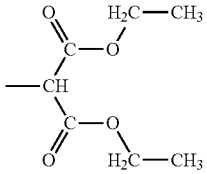
(7)
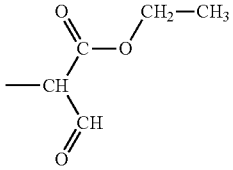
(B)
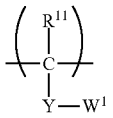
In formula (B), $R^{11}$ represents a hydrogen atom or an alkyl group, Y represents a single bond or a phenylene group, and $W^1$ represents a hydroxy group, a thiol group, an amino group, or a carboxyl group.
(A1)
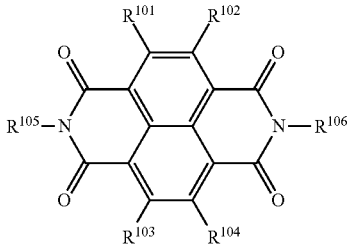
-continued
(A2)
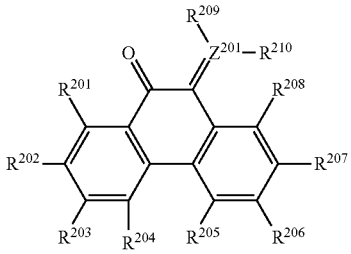
(A3)
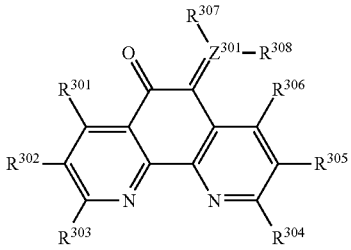
(A4)
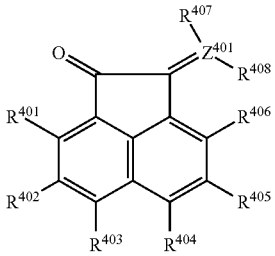
(A5)
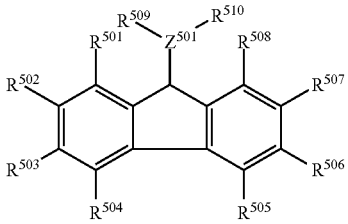
(A6)
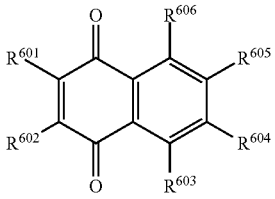

-continued (A7)

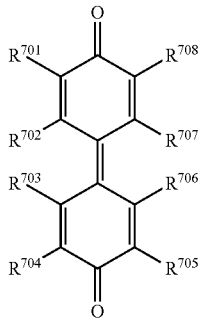

(A8)

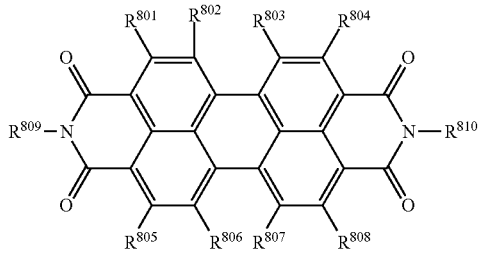

In formulae (A1) to (A8), $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, and $R^{801}$ to $R^{810}$ each independently represents a monovalent group represented by formula (A) below, a hydrogen atom, a cyano group, a nitro group, a halogen atom, an alkoxycarbonyl group, a substituted or unsubstituted alkyl group, a substituted or unsubstituted aryl group, or a substituted or unsubstituted heterocyclic group; at least one of $R^{101}$ to $R^{106}$, at least one of $R^{201}$ to $R^{210}$, at least one of $R^{301}$ to $R^{308}$, at least one of $R^{401}$ to $R^{408}$, at least one of $R^{501}$ to $R^{510}$, at least one of $R^{601}$ to $R^{606}$, at least one of $R^{701}$ to $R^{708}$, and at least one of $R^{801}$ to $R^{810}$ are the monovalent group represented by formula (A); one of carbon atoms of the alkyl group may be replaced with O, S, NH, or $NR^{901}$ (where $R^{901}$ is an alkyl group); the substituent of the substituted alkyl group is a group selected from the group consisting of an alkyl group, an aryl group, an alkoxycarbonyl group, and a halogen atom; the substituent of the substituted aryl group is a group selected from the group consisting of a halogen atom, a nitro group, a cyano group, an alkyl group, and a halogen-substituted alkyl group; $Z^{201}$, $Z^{301}$, $Z^{401}$, and $Z^{501}$ each independently represents a carbon atom, a nitrogen atom, or an oxygen atom; $R^{209}$ and $R^{210}$ are absent when $Z^{201}$ is an oxygen atom; $R^{210}$ is absent when $Z^{201}$ is a nitrogen atom; $R^{307}$ and $R^{308}$ are absent when $Z^{301}$ is an oxygen atom; $R^{308}$ is absent when $Z^{301}$ is a nitrogen atom; $R^{407}$ and $R^{408}$ are absent when $Z^{401}$ is an oxygen atom; $R^{408}$ is absent when $Z^{401}$ is a nitrogen atom; $R^{509}$ and $R^{510}$ are absent when $Z^{501}$ is an oxygen atom; $R^{510}$ is absent when $Z^{501}$ is a nitrogen atom.

$$-(\alpha)_l-(\beta)_m\gamma \quad (A)$$

In Formula (A), at least one of α, β, and γ is a group having a substituent, the substituent being at least one substituent selected from the group consisting of a hydroxy group, a thiol group, an amino group, and a carboxyl group; l and m each independently represents 0 or 1; and the sum of l and m is 0 to 2.

In Formula (A), α represents an alkylene group having 1 to 6 main-chain atoms, an alkylene group having 1 to 6 main-chain atoms and substituted with an alkyl group having 1 to 6 carbon atoms, an alkylene group having 1 to 6 main-chain atoms and substituted with a benzyl group, an alkylene group having 1 to 6 main-chain atoms and substituted with an alkoxycarbonyl group, or an alkylene group having 1 to 6 main-chain atoms and substituted with a phenyl group, and may have at least one substituent selected from the group consisting of a hydroxy group, a thiol group, an amino group, and a carboxyl group. One of the carbon atoms in the main chain of the alkylene group may be replaced with O, S, NH, or $NR^{19}$, $R^{19}$ representing an alkyl group.

In Formula (A), β represents a phenylene group, a phenylene group substituted with an alkyl group having 1 to 6 carbon atoms, a phenylene group substituted with a nitro group, a phenylene group substituted with a halogen atom, or a phenylene group substituted with an alkoxy group. These groups may each have at least one substituent selected from the group consisting of a hydroxy group, a thiol group, an amino group, and a carboxyl group.

In Formula (A), γ represents a hydrogen atom, an alkyl group having 1 to 6 main-chain atoms, or an alkyl group having 1 to 6 main-chain atoms and substituted with an alkyl group having 1 to 6 carbon atoms and may have at least one substituent selected from the group consisting of a hydroxy group, a thiol group, an amino group, and a carboxyl group. One of the carbon atoms in the main chain of the alkyl group may be replaced with $NR^{902}$ (where $R^{902}$ is an alkyl group).

The polymerized product content relative to the total mass of the undercoat layer is preferably 50% by mass or more and 100% by mass or less and more preferably 80% by mass or more and 100% by mass or less from the viewpoint of suppressing ghosting.

The undercoat layer may contain other resins, a crosslinking agent other than the isocyanate compound described above, organic particles, inorganic particles, and a leveling agent in addition to the polymerized product described above in order to enhance the film forming property and electrical properties of the undercoat layer. However, the contents of these agents in the undercoat layer are preferably less than 50% by mass and more preferably less than 20% by mass relative to the total mass of the undercoat layer.

Electron Transport Substance

The compound represented by any one of formulae (A1) to (A8) may have a molecular weight of 150 or more and 1000 or less. At this molecular weight, the structures derived from the electron transporting substance are more evenly distributed in the undercoat layer.

From the viewpoint of evenness of the structures derived from the electron transporting substance, the ratio of the molecular weight of the compound represented by any one of formulae (A1) to (A8) to the molecular weight of the isocyanate compound described above is preferably 3/20 to 50/20 and more preferably 12/20 to 28/20.

Specific examples of the electron transporting substance are shown below. In Tables 1-1, 1-2, 1-3, and 1-4, specific examples of the compound represented by formula (A1) are given. In the tables, γ represents a hydrogen atom when "-" appears in the γ column and this hydrogen atom appears in the α column or the β column.

TABLE 1-1
| Example compound | $R^{101}$ | $R^{102}$ | $R^{103}$ | $R^{104}$ | $R^{105}$ | $R^{106}$ | A α | A β | A γ |
|---|---|---|---|---|---|---|---|---|---|
| A101 | H | H | H | H | 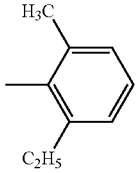 | A | 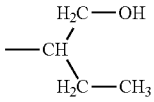 | — | — |
| A102 | H | H | H | H | 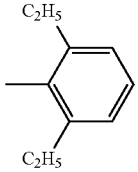 | A | 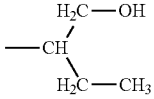 | — | — |
| A103 | H | H | H | H | 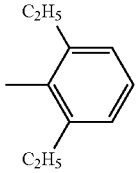 | A | — | 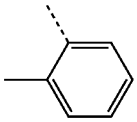 | 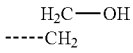 |
| A104 | H | H | H | H | 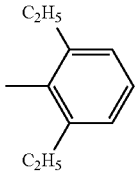 | A | — | 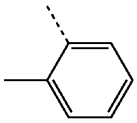 | - - - -$CH_2$—OH |
| A105 | H | H | H | H | 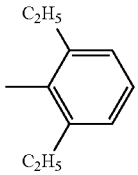 | A | — | 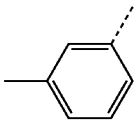 | - - - -$CH_2$—OH |
| A106 | H | H | H | H | 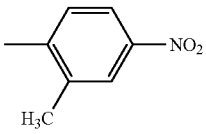 | A | 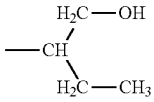 | — | — |
| A107 | H | H | H | H | 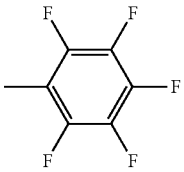 | A | 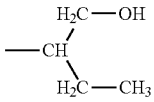 | — | — |
| A108 | H | H | H | H | 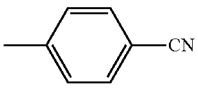 | A | 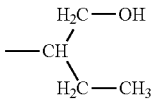 | — | — |
| A109 | H | H | H | H | 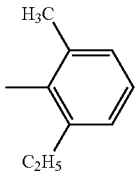 | A | —$C_5H_{10}$—OH | — | — |

TABLE 1-1-continued
| Example compound | $R^{101}$ | $R^{102}$ | $R^{103}$ | $R^{104}$ | $R^{105}$ | $R^{106}$ | A α | A β | A γ |
|---|---|---|---|---|---|---|---|---|---|
| A110 | H | H | H | H | $-C_6H_{13}$ | A | 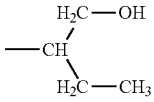 | — | — |
| A111 | H | H | H | H | 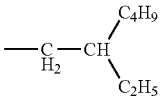 | A | — | 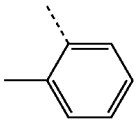 | 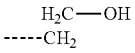 |
| A112 | H | H | H | H | 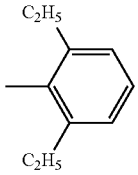 | A | — | 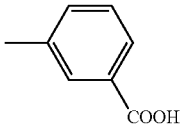 | — |
| A113 | H | H | H | H | 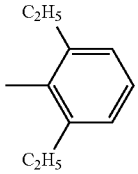 | A | — | 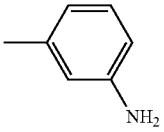 | — |
| A114 | H | H | H | H | 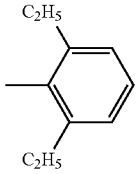 | A | — | 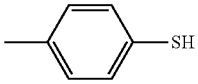 | — |
| A115 | H | H | H | H | 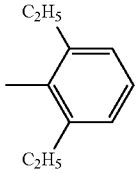 | A | — | 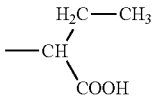 | — |
| A150 | H | H | H | H | 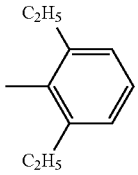 | A | — | 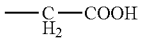 | — |
TABLE 1-2
| | | | | | | | |
|---|---|---|---|---|---|---|---|
| A116 | H | H | H | H | 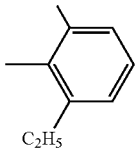 | A | — |

TABLE 1-2-continued
| | | | | | | | |
|---|---|---|---|---|---|---|---|
| A117 | H | H | H | H | $C_2H_5$ 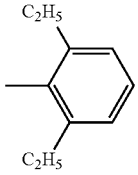 $C_2H_5$ | A | — |
| A118 | 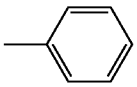 | H | H | 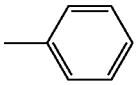 | $C_2H_5$ 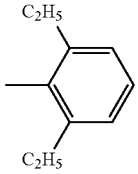 $C_2H_5$ | A | $H_2C$—OH / —CH \ $H_2C$—$CH_3$ |
| A119 | CN | H | H | CN | $H_3C$ 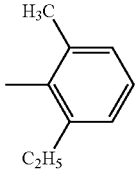 $C_2H_5$ | A | $H_2C$—OH / —CH \ $H_2C$—$CH_3$ |
| A120 | A | H | H | H | $H_3C$ 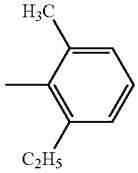 $C_2H_5$ | $H_3C$ 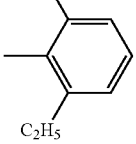 $C_2H_5$ | — |
| A121 | H | NO2 | H | NO2 | $H_3C$ 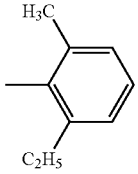 $C_2H_5$ | A | $H_2C$—OH / —CH \ $H_2C$—$CH_3$ |
| A122 | H | H | H | H | $H_3C$ 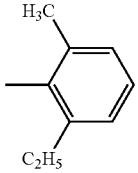 $C_2H_5$ | A | $H_2C$—OH / —CH \ $H_2C$—OH |
| A123 | H | NO2 | H | NO2 | A | A | $H_2C$—OH / —CH \ $H_2C$—$CH_3$ |
| A124 | H | H | H | H | A | A | — |
| A125 | H | H | H | H | A | A | — |
| A126 | H | H | H | H | A | A | — |
| A127 | H | H | H | H | A | A | — |
| A128 | H | H | H | H | A | A | — |
| A129 | H | H | H | H | A | A | — |
| A130 | H | H | H | H | $H_3C$ 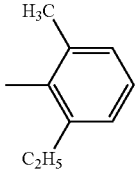 $C_2H_5$ | A | $H_2C$—OH / —CH \ $H_2C$—OH |

TABLE 1-2-continued
| | | | | | | | |
|---|---|---|---|---|---|---|---|
| A131 | H | H | H | H | 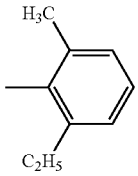 | A | 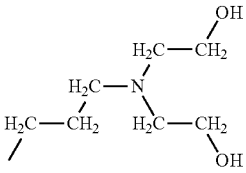 |
| A132 | H | H | H | H | 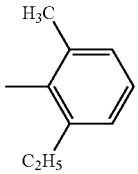 | A | 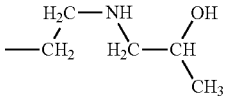 |
| | | | | | A116 | 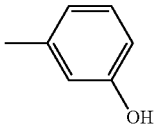 | — |
| | | | | | A117 | 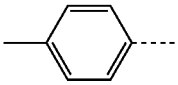 | 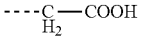 |
| | | | | | A118 | — | — |
| | | | | | A119 | — | — |
| | | | | | A120 | — | —COOH |
| | | | | | A121 | — | — |
| | | | | | A122 | — | — |
| | | | | | A123 | — | — |
| | | | | | A124 | 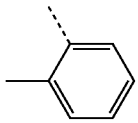 | 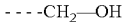 |
| | | | | | A125 | 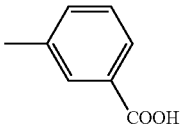 | — |
| | | | | | A126 | 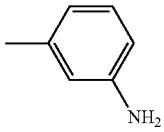 | — |
| | | | | | A127 | 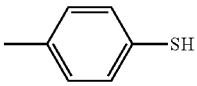 | — |
| | | | | | A128 | 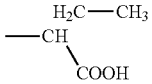 | — |
| | | | | | A129 | 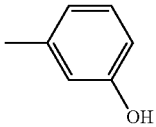 | — |
| | | | | | A130 | — | — |
| | | | | | A131 | — | — |
| | | | | | A132 | — | — |

TABLE 1-3
| | | | | | | | | | |
|---|---|---|---|---|---|---|---|---|---|
| A133 | H | H | H | H | 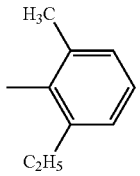 | A | 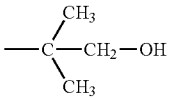 | — | — |
| A134 | H | H | H | H | A | A | 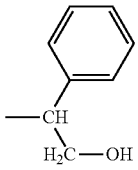 | — | — |
| A135 | H | H | H | H | A | A | 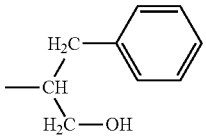 | — | — |
| A136 | H | H | H | H | A | A | 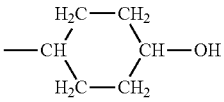 | — | — |
| A137 | H | H | H | H | A | A | — | 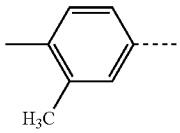 | 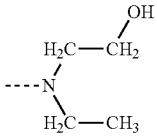 |
| A138 | H | H | H | H | 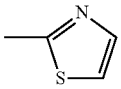 | A | 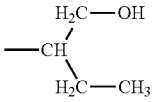 | — | — |
| A139 | H | H | H | H | 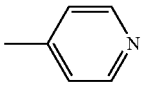 | A | 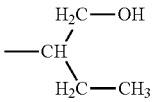 | — | — |
| A140 | H | H | H | H | 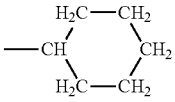 | A | 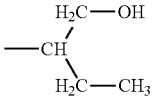 | — | — |
| A141 | H | H | H | H | A | A | 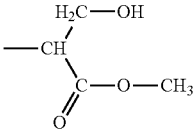 | — | — |
| A142 | CN | H | H | CN | 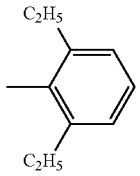 | A | 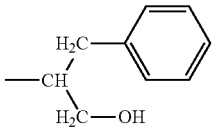 | — | — |
| A143 | H | H | H | H | $—C_2H_4—O—C_2H_5$ | A | 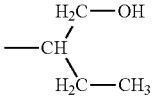 | — | — |

TABLE 1-3-continued
| | | | | | | | | | |
|---|---|---|---|---|---|---|---|---|---|
| A144 | H | H | H | H | 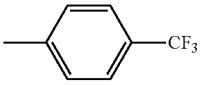 | A | —$C_2H_4$—O—$C_2H_4$—OH | — | — |
| A145 | H | H | H | H | A | A | 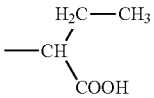 | — | — |
| A146 | H | H | H | H | 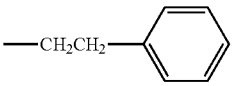 | A | 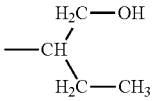 | — | — |
| A147 | H | H | H | H | 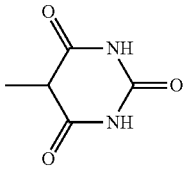 | A | —$C_2H_4$—O—$C_2H_4$—OH | — | — |
| A148 | H | H | H | H | 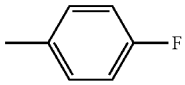 | A | —$CH_2CH_2$- - - | 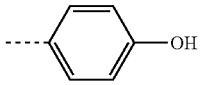 | — |
| A149 | H | H | H | H | 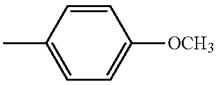 | A | — | 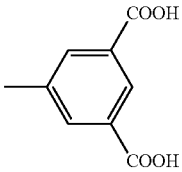 | — |
TABLE 1-4
| Example compound | $R^{101}$ | $R^{102}$ | $R^{103}$ | $R^{104}$ | $R^{105}$ | $R^{106}$ | A α | A β | A γ | A' α | A' β | A' γ |
|---|---|---|---|---|---|---|---|---|---|---|---|---|
| A150 | H | H | H | H | A | A' | 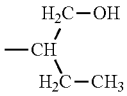 | — | — | — | 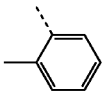 | - - - -$CH_2$—OH |
| A151 | H | H | H | H | A | A' | — | 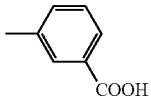 | — | 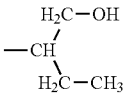 | — | — |
TABLE 1-5
| Example compound | $R^{101}$ | $R^{102}$ | $R^{103}$ | $R^{104}$ | $R^{105}$ | $R^{106}$ | A α | A β | A γ |
|---|---|---|---|---|---|---|---|---|---|
| A153 | H | H | H | H | A | A | 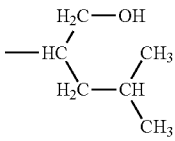 | — | — |

TABLE 1-5-continued
| Example compound | $R^{101}$ | $R^{102}$ | $R^{103}$ | $R^{104}$ | $R^{105}$ | $R^{106}$ | A α | A β | A γ |
|---|---|---|---|---|---|---|---|---|---|
| A154 | H | H | H | H | A | A | 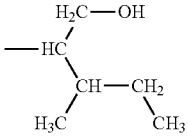 | — | — |
| A155 | H | H | H | H | A | A | 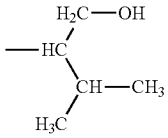 | — | — |
| A156 | H | H | H | H | $—C_6H_{12}—OH$ | A | 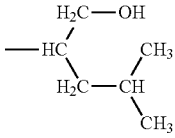 | — | — |
| A157 | H | H | H | H | 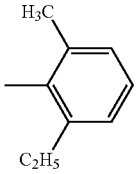 | A | 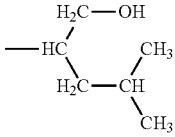 | — | — |
| A158 | H | H | H | H | A | A | 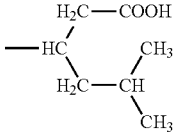 | — | — |
| A159 | H | H | H | H | 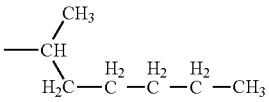 | A | $—C_2H_4—S—C_2H_4—OH$ | — | — |
| A160 | H | H | H | H | A | A | 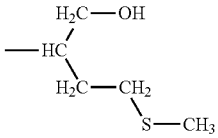 | — | — |
| A161 | H | H | H | H | A | A | 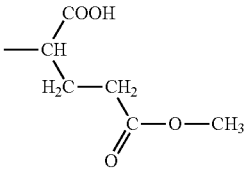 | — | — |
| A162 | H | H | H | H | $—C_2H_4—O—C_2H_5$ | A | 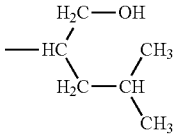 | — | — |
| A163 | H | H | H | H | $—C_2H_4—S—C_2H_5$ | A | 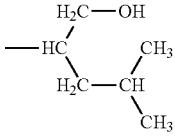 | — | — |

TABLE 1-5-continued
| Example compound | $R^{101}$ | $R^{102}$ | $R^{103}$ | $R^{104}$ | $R^{105}$ | $R^{106}$ | A α | A β | A γ |
|---|---|---|---|---|---|---|---|---|---|
| A164 | H | H | H | H | $-C_2H_4-\overset{H}{N}-C_4H_9$ | A | 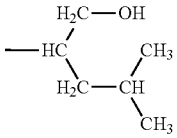 | — | — |
| A165 | H | H | H | H | 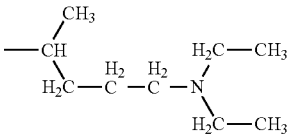 | A | 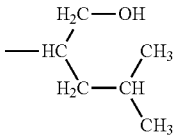 | — | — |
| A166 | H | H | H | H | 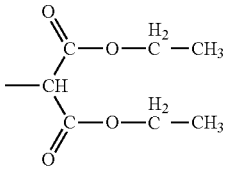 | A | 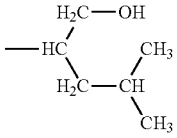 | — | — |
25
TABLE 1-6
| Example compound | $R^{101}$ | $R^{102}$ | $R^{103}$ | $R^{104}$ | $R^{105}$ | $R^{106}$ | A α | A β | A γ | A' α | A' β | A' γ |
|---|---|---|---|---|---|---|---|---|---|---|---|---|
| A167 | H | H | H | H | A | A' | 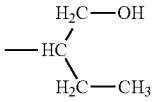 | — | — | 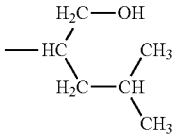 | — | — |
| A168 | H | H | H | H | A | A' | $-C_2H_4-O-C_2H_4-OH$ | — | — | 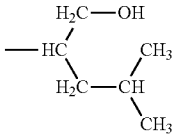 | — | — |
| A169 | H | H | H | H | A | A' | $-C_6H_{12}-OH$ | — | — | 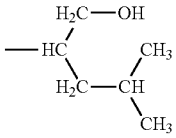 | — | — |
| A170 | H | H | H | H | A | A' | $-C_3H_6-\overset{H}{N}-C_2H_4-OH$ | — | — | 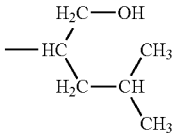 | — | — |
| A171 | H | H | H | H | A | A' | $-C_2H_4-O-C_2H_4-OH$ | — | — | 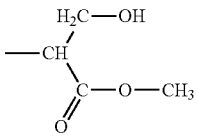 | — | — |

TABLE 1-6-continued

| Example compound | $R^{101}$ | $R^{102}$ | $R^{103}$ | $R^{104}$ | $R^{105}$ | $R^{106}$ | A α | A β | A γ | A' α | A' β | A' γ |
|---|---|---|---|---|---|---|---|---|---|---|---|---|
| A172 | H | H | H | H | A | A' | —$C_2H_4$—O—$C_2H_4$—OH | — | — | 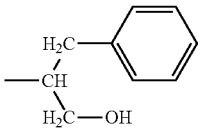 | — | — |
| A173 | H | H | H | H | A | A' | —$C_2H_4$—S—$C_2H_4$—OH | — | — | 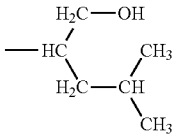 | — | — |
| A174 | H | H | H | H | A | A' | 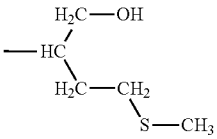 | — | — | 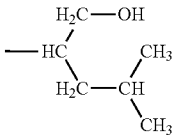 | — | — |
| A175 | H | H | H | H | A | A' | 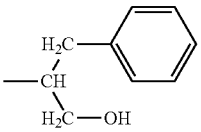 | — | — | 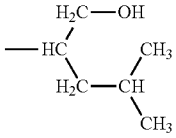 | — | — |
| A176 | H | H | H | H | A | A' | 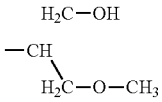 | — | — | 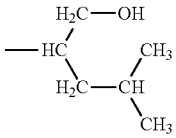 | — | — |
| A177 | H | H | H | H | A | A' | —$C_2H_4$—S—$C_2H_4$—OH | — | — | 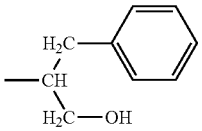 | — | — |

In Tables 2-1 and 2-2, specific examples of the compound represented by formula (A-2) are given. In the tables, γ represents a hydrogen atom when "-" appears in the γ column and this hydrogen atom appears in the α column or the β column.

TABLE 2-1

| Example compound | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ | A α | A β | A γ |
|---|---|---|---|---|---|---|---|---|---|---|---|---|---|---|
| A201 | H | H | A | H | H | H | H | H | — | — | O | — | 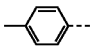 | ---$CH_2$—OH |
| A202 | H | H | A | H | H | H | H | H | — | — | O | — | 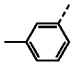 | ---$CH_2$—OH |
| A204 | H | H | A | H | H | H | H | H | — | — | O | — | 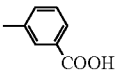 | — |
| A205 | H | H | A | H | H | H | H | H | — | — | O | — | 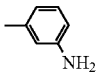 | — |

TABLE 2-1-continued

| Example compound | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ | A α | A β | A γ |
|---|---|---|---|---|---|---|---|---|---|---|---|---|---|---|
| A206 | H | H | A | H | H | H | H | H | — | — | O | — | 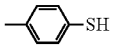 | — |
| A207 | H | H | H | H | H | H | H | H | A | — | N | — | 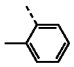 | $H_2C—OH$ / ---$CH_2$ |
| A208 | H | H | H | H | H | H | H | H | A | — | N | — | 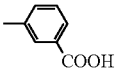 | — |
| A209 | H | H | H | H | H | H | H | H | A | — | N | — | 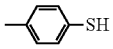 | — |
| A210 | H | H | H | H | H | H | H | H | A | — | N | $H_2C—OH$ / —CH \ $H_2C—CH_3$ | — | — |
| A211 | CH3 | H | H | H | H | H | H | $CH_3$ | A | — | N | — | 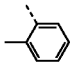 | $H_2C—OH$ / ---$CH_2$ |
| A212 | H | Cl | H | H | H | H | Cl | H | A | — | N | — | 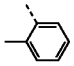 | $H_2C—OH$ / ---$CH_2$ |
| A213 | H | H | 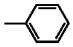 | H | H | 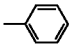 | H | H | A | — | N | — | 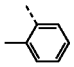 | $H_2C—OH$ / ---$CH_2$ |
| A214 | H | H | —C(=O)—O—$C_2H_5$ | H | H | —C(=O)—O—$C_2H_5$ | H | H | A | — | N | — | 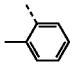 | $H_2C—OH$ / ---$CH_2$ |
| A215 | H | H | H | $NO_2$ | $NO_2$ | H | H | H | A | — | N | — | 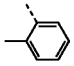 | $H_2C—OH$ / ---$CH_2$ |
| A216 | H | H | A | H | H | A | H | H | — | — | O | — | 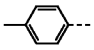 | ---$CH_2$—OH |
| A217 | H | H | A | H | H | A | H | H | — | — | O | — | 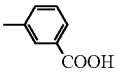 | — |

TABLE 2-2

| | | | | | | | | | | | | | | |
|---|---|---|---|---|---|---|---|---|---|---|---|---|---|---|
| A218 | H | H | A | H | H | A | H | H | — | — | O | — | 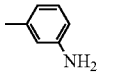 | — |
| A219 | H | H | A | H | H | A | H | H | — | — | O | — | 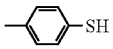 | — |
| A220 | H | H | A | H | H | A | H | H | — | — | O | $H_2C—OH$ / —CH \ $H_2C—CH_3$ | — | — |
| A221 | H | H | A | H | H | A | H | H | — | — | O | $H_2C—OH$ / —$CH_2$ | — | — |
| A222 | H | H | A | H | H | A | H | H | — | — | O | — | — | COOH |

TABLE 2-2-continued

| | | | | | | | | | | | | | | |
|---|---|---|---|---|---|---|---|---|---|---|---|---|---|---|
| A223 | H | H | A | H | H | A | H | H | | — | O | — | — | $NH_2$ |
| A224 | H | A | H | H | H | H | A | H | | — | O | — | 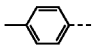 | ---$CH_2$—OH |
| A225 | H | H | A | H | H | A | H | H | CN | CN | C | — | 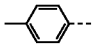 | ---$CH_2$—OH |
| A226 | H | H | A | H | H | A | H | H | CN | CN | C | — | 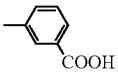 | — |
| A227 | H | H | A | H | H | A | H | H | CN | CN | C | — | 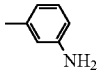 | — |
| A228 | H | H | A | H | H | A | H | H | CN | CN | C | — | 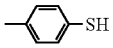 | — |
| A229 | H | H | A | H | H | A | H | H | CN | 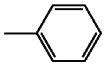 | C | — | 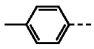 | ---$CH_2$—OH |
| A230 | H | H | A | H | H | A | H | H | 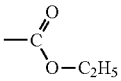 | 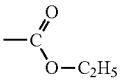 | C | — | 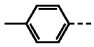 | ---$CH_2$—OH |
| A231 | H | H | H | H | H | H | H | H | A | A | C | — | — | COOH |
| A232 | H | $NO_2$ | H | H | H | H | $NO_2$ | H | A | — | N | — | 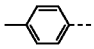 | $H_2C$—OH<br>---$CH_2$ |
| A233 | H | H | | H | H | A | H | H | — | — | O | — | 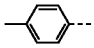 | ---$CH_2$—OH |

In Tables 3-1 and 3-2, specific examples of the compound represented by formula (A-3) are given. In the tables, γ represents a hydrogen atom when "-" appears in the γ column and this hydrogen atom appears in the α column or the β column.

TABLE 3-1

| Example compound | $R^{301}$ | $R^{302}$ | $R^{303}$ | $R^{304}$ | $R^{305}$ | $R^{306}$ | $R^{307}$ | $R^{308}$ | $Z^{301}$ | A α | A β | A γ |
|---|---|---|---|---|---|---|---|---|---|---|---|---|
| A301 | H | A | H | H | H | H | — | — | O | — | 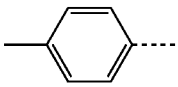 | ---$CH_2$—OH |
| A302 | H | A | H | H | H | H | — | — | O | — | 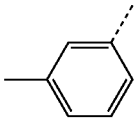 | ---$CH_2$—OH |
| A303 | H | A | H | H | H | H | — | — | O | — | 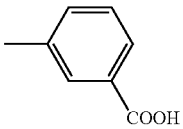 | — |
| A304 | H | A | H | H | H | H | — | — | O | — | 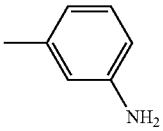 | — |

TABLE 3-1-continued
| Example compound | $R^{301}$ | $R^{302}$ | $R^{303}$ | $R^{304}$ | $R^{305}$ | $R^{306}$ | $R^{307}$ | $R^{308}$ | $Z^{301}$ | A α | A β | A γ |
|---|---|---|---|---|---|---|---|---|---|---|---|---|
| A305 | H | A | H | H | H | H | — | — | O | — | 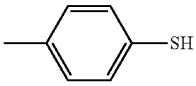 | — |
| A306 | H | H | H | H | H | H | A | — | N | — | 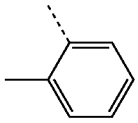 | $H_2C-OH$ / ---$CH_2$ |
| A307 | H | H | H | H | H | H | A | — | N | — | 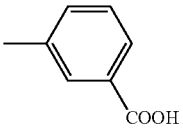 | — |
| A308 | H | H | H | H | H | H | A | — | N | $H_2C-OH$ / $-CH$ \ $H_2C-CH_3$ | — | — |
| A309 | $CH_3$ | H | H | H | H | $CH_3$ | A | — | N | — | 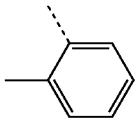 | $H_2C-OH$ / ---$CH_2$ |
| A310 | H | H | Cl | Cl | H | H | A | — | N | — | 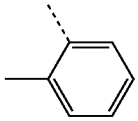 | $H_2C-OH$ / ---$CH_2$ |
| A311 | H | 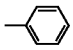 | H | H | 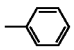 | H | A | — | N | — | 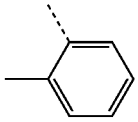 | $H_2C-OH$ / ---$CH_2$ |
| A312 | H | $-C(=O)-O-C_2H_5$ | H | H | $-C(=O)-O-C_2H_5$ | H | A | — | N | — | 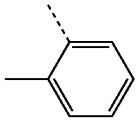 | $H_2C-OH$ / ---$CH_2$ |
| A313 | H | H | H | H | H | H | A | — | N | — | 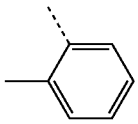 | $H_2C-OH$ / ---$CH_2$ |
| A314 | H | A | H | H | A | H | — | — | O | — | 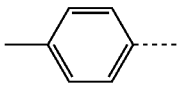 | ---$CH_2-OH$ |
| A315 | H | A | H | H | A | H | — | — | O | — | 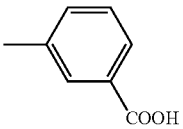 | — |

TABLE 3-2
| | | | | | | | | | | | | |
|---|---|---|---|---|---|---|---|---|---|---|---|---|
| A316 | H | A | H | H | A | H | — | — | O | — | 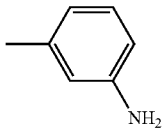 | — |
| A317 | H | A | H | H | A | H | — | — | O | — | 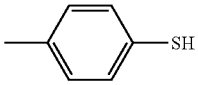 | — |
| A318 | H | A | H | H | A | H | — | — | O | 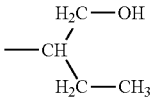 | — | — |
| A319 | H | A | H | H | A | H | — | — | O | 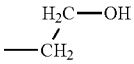 | — | — |
| A320 | H | A | H | H | A | H | — | — | O | — | — | COOH |
| A321 | H | A | H | H | A | H | — | — | O | — | — | $NH_2$ |
| A322 | H | H | A | A | H | H | — | — | O | — | 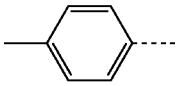 | ----$CH_2$—OH |
| A323 | H | A | H | H | A | H | CN | CN | C | — | 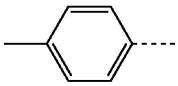 | ----$CH_2$—OH |
| A324 | H | A | H | H | A | H | CN | CN | C | — | 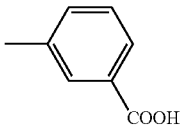 | — |
| A325 | H | A | H | H | A | H | CN | CN | C | — | 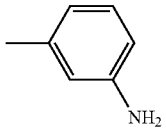 | — |
| A326 | H | A | H | H | A | H | CN | CN | C | — | 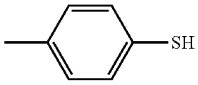 | — |
| A327 | H | A | H | H | A | H | CN | 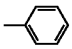 | C | — | 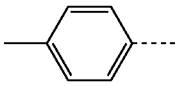 | ----$CH_2$—OH |
| A328 | H | A | H | H | A | H | 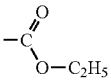 | 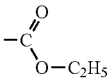 | C | — | 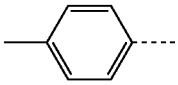 | ----$CH_2$—OH |
| A329 | H | H | H | H | H | H | A | A | C | — | — | COOH |
| A330 | H | H | H | H | H | H | A | — | N | — | 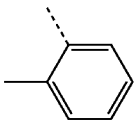 | 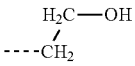 |

In Tables 4-1 and 4-2, specific examples of the compound represented by formula (A-4) are given. In the tables, γ represents a hydrogen atom when "-" appears in the γ column and this hydrogen atom appears in the α column or the β column.

TABLE 4-1

| Example compound | $R^{401}$ | $R^{402}$ | $R^{403}$ | $R^{404}$ | $R^{405}$ | $R^{406}$ | $R^{407}$ | $R^{408}$ | $Z^{401}$ | A α | A β | A γ |
|---|---|---|---|---|---|---|---|---|---|---|---|---|
| A401 | H | H | A | H | H | H | CN | CN | C | — | 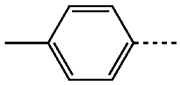 | ---$CH_2$—OH |
| A402 | H | H | A | H | H | H | CN | CN | C | — | 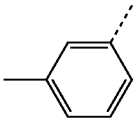 | ---$CH_2$—OH |
| A403 | H | H | A | H | H | H | CN | CN | C | — | 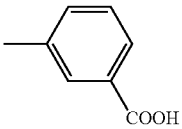 | — |
| A404 | H | H | A | H | H | H | CN | CN | C | — | 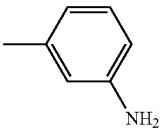 | — |
| A405 | H | H | A | H | H | H | CN | CN | C | — | 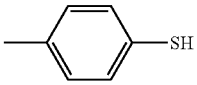 | — |
| A406 | H | H | H | H | H | H | A | — | N | — | 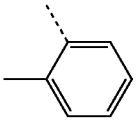 | $H_2C$—OH / ---$CH_2$ |
| A407 | H | H | H | H | H | H | A | — | N | — | 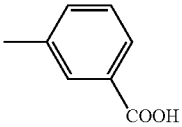 | — |
| A408 | H | H | H | H | H | H | A | — | N | — | 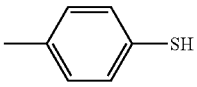 | — |
| A409 | H | H | H | H | H | H | A | — | N | $H_2C$—OH / —CH \ $H_2C$—$CH_3$ | — | — |
| A410 | $CH_3$ | H | H | H | H | $CH_3$ | A | — | N | — | 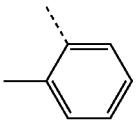 | $H_2C$—OH / ---$CH_2$ |
| A411 | H | Cl | H | H | Cl | H | A | — | N | — | 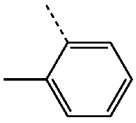 | $H_2C$—OH / ---$CH_2$ |

TABLE 4-1-continued

| Example compound | $R^{401}$ | $R^{402}$ | $R^{403}$ | $R^{404}$ | $R^{405}$ | $R^{406}$ | $R^{407}$ | $R^{408}$ | $Z^{401}$ | A α | A β | A γ |
|---|---|---|---|---|---|---|---|---|---|---|---|---|
| A412 | H | H | 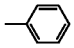 | 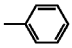 | H | H | A | — | N | — | 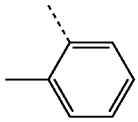 | $H_2C-OH$ / ---$CH_2$ |
| A413 | H | H | $-C(=O)-O-C_2H_5$ | $-C(=O)-O-C_2H_5$ | H | H | A | — | N | — | 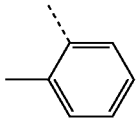 | $H_2C-OH$ / ---$CH_2$ |
| A414 | H | H | H | H | H | H | A | — | N | — | 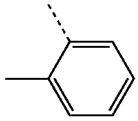 | $H_2C-OH$ / ---$CH_2$ |
| A415 | H | H | A | A | H | H | CN | CN | C | — | 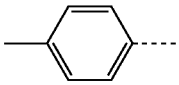 | ---$CH_2-OH$ |

TABLE 4-2

| | | | | | | | | | | | | |
|---|---|---|---|---|---|---|---|---|---|---|---|---|
| A416 | H | H | A | A | H | H | CN | CN | C | — | 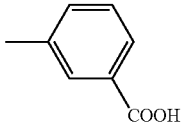 | — |
| A417 | H | H | A | A | H | H | CN | CN | C | — | 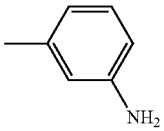 | — |
| A418 | H | H | A | A | H | H | CN | CN | C | — | 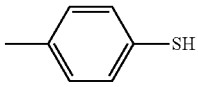 | — |
| A419 | H | H | A | A | H | H | CN | CN | C | $H_2C-OH$ / $-CH$ \ $H_2C-CH_3$ | — | — |
| A420 | H | H | A | A | H | H | CN | CN | C | $H_2C-OH$ / $-CH_2$ | — | — |
| A421 | H | H | A | A | H | H | CN | CN | C | — | — | COOH |
| A422 | H | H | A | A | H | H | CN | CN | C | — | — | $NH_2$ |
| A423 | H | A | H | H | A | H | CN | CN | C | — | 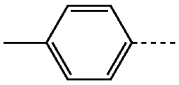 | ----$CH_2-OH$ |
| A423 | H | H | A | A | H | H | — | — | O | — | 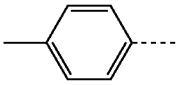 | ----$CH_2-OH$ |

TABLE 4-2-continued

| | | | | | | | | | | | |
|---|---|---|---|---|---|---|---|---|---|---|---|
| A424 | H | H | A | A | H | H | — | — | O | — | 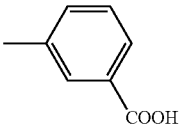 — |
| A425 | H | H | A | A | H | H | — | — | O | — | 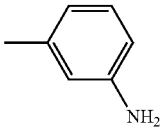 — |
| A426 | H | H | A | A | H | H | — | — | O | — | 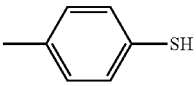 — |
| A427 | H | H | A | A | H | H | CN | 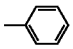 | C | — | 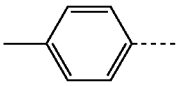 ----$CH_2$—OH |
| A428 | H | H | A | A | H | H | 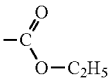 | 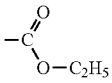 | C | — | 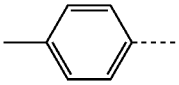 ----$CH_2$—OH |
| A429 | H | H | H | H | H | H | A | A | C | — | — COOH |
| A430 | H | H | H | A | H | H | CN | CN | C | — | 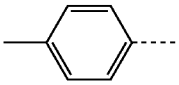 $H_2C$—OH / ----$CH_2$ |
| A431 | H | H | 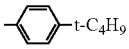 t-$C_4H_9$ | A | H | H | 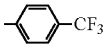 $CF_3$ | — | N | — | 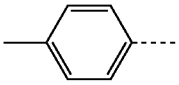 $H_2C$—OH / ----$CH_2$ |

In Tables 5-1 and 5-2, specific examples of the compound represented by formula (A-5) are given. In the tables, γ represents a hydrogen atom when "-" appears in the γ column and this hydrogen atom appears in the α column or the β column.

TABLE 5-1

| Example compound | $R^{501}$ | $R^{502}$ | $R^{503}$ | $R^{504}$ | $R^{505}$ | $R^{506}$ | $R^{507}$ | $R^{508}$ | $R^{509}$ | $R^{510}$ | $Z^{501}$ | A α | A β | A γ |
|---|---|---|---|---|---|---|---|---|---|---|---|---|---|---|
| A501 | H | A | H | H | H | H | H | H | CN | CN | C | — | 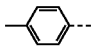 | ---$CH_2$—OH |
| A502 | H | A | H | H | H | H | H | H | CN | CN | C | — | 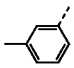 | ---$CH_2$—OH |
| A503 | H | A | H | H | H | H | H | H | CN | CN | C | — | 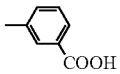 COOH | — |
| A504 | H | A | H | H | H | H | H | H | CN | CN | C | — | 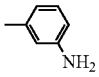 $NH_2$ | — |
| A505 | H | A | H | H | H | H | H | H | CN | CN | C | — | 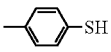 SH | — |
| A506 | H | $NO_2$ | H | H | $NO_2$ | H | $NO_2$ | H | A | — | N | — | 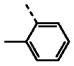 | $H_2C$—OH / ---$CH_2$ |

TABLE 5-1-continued

| Example compound | $R^{501}$ | $R^{502}$ | $R^{503}$ | $R^{504}$ | $R^{505}$ | $R^{506}$ | $R^{507}$ | $R^{508}$ | $R^{509}$ | $R^{510}$ | $Z^{501}$ | A α | A β | A γ |
|---|---|---|---|---|---|---|---|---|---|---|---|---|---|---|
| A507 | H | H | H | H | H | H | H | H | A | — | N | — | 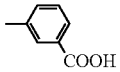 | — |
| A508 | H | H | H | H | H | H | H | H | A | — | N | — | 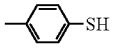 | — |
| A509 | H | H | H | H | H | H | H | H | A | — | N | 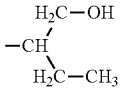 | — | — |
| A510 | $CH_3$ | H | H | H | H | H | H | $CH_3$ | A | — | N | — | 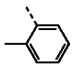 | 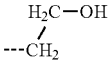 |
| A511 | H | H | Cl | H | H | Cl | H | H | A | — | N | — | 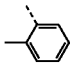 | 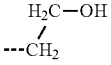 |
| A512 | H | 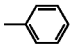 | H | H | H | H | 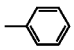 | H | A | — | N | — | 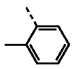 | 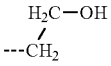 |
| A513 | H | 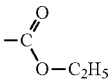 | H | H | H | H | 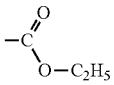 | H | A | — | N | — | 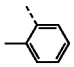 | 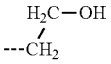 |
| A514 | H | $NO_2$ | H | H | $NO_2$ | H | $NO_2$ | H | A | — | N | — | 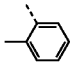 | 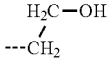 |
| A515 | H | A | H | H | H | H | A | H | CN | CN | C | — | 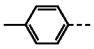 | ---$CH_2$—OH |
| A516 | H | A | H | H | H | H | A | H | CN | CN | C | — | 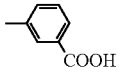 | — |

TABLE 5-2

| | | | | | | | | | | | | | | |
|---|---|---|---|---|---|---|---|---|---|---|---|---|---|---|
| A517 | H | A | H | H | H | H | A | H | CN | CN | C | — | 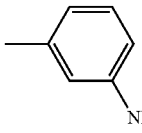 | — |
| A518 | H | A | H | H | H | H | A | H | CN | CN | C | — | 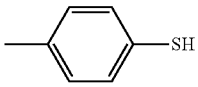 | — |
| A519 | H | A | H | H | H | H | A | H | CN | CN | C | 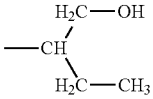 | — | — |
| A520 | H | A | H | H | H | H | A | H | CN | CN | C | 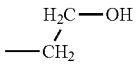 | — | — |
| A521 | H | A | H | H | H | H | A | H | CN | CN | C | — | — | COOH |
| A522 | H | A | H | H | H | H | A | H | CN | CN | C | — | — | NH2 |

TABLE 5-2-continued

| | | | | | | | | | | | | | | |
|---|---|---|---|---|---|---|---|---|---|---|---|---|---|---|
| A523 | H | H | A | H | H | A | H | H | CN | CN | C | — | 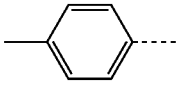 | ---$CH_2$—OH |
| A524 | H | A | H | H | H | H | A | H | — | — | O | — | 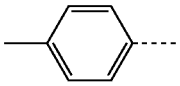 | ---$CH_2$—OH |
| A525 | H | A | H | H | H | H | A | H | — | — | O | — | 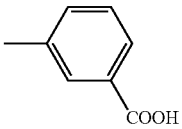 | — |
| A526 | H | A | H | H | H | H | A | H | — | — | O | — | 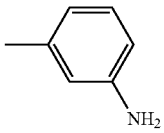 | — |
| A527 | H | A | H | H | H | H | A | H | — | — | O | — | 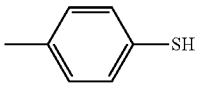 | — |
| A528 | H | A | H | H | H | H | A | H | CN | 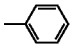 | C | — | 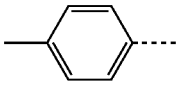 | ---$CH_2$—OH |
| A529 | H | A | H | H | H | H | A | H | 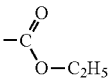 | 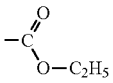 | C | — | 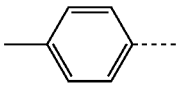 | ---$CH_2$—OH |
| A530 | H | H | H | H | H | H | H | H | A | A | C | — | — | COOH |
| A531 | H | A | H | H | H | H | A | H | CN | CN | C | — | 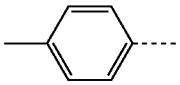 | ---$CH_2$—OH |
| A532 | H | A | H | H | H | H | — | — | 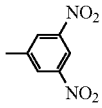 | — | N | — | 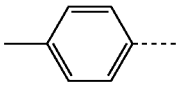 | ---$CH_2$—OH |

In Table 6, specific examples of the compound represented by formula (A-6) are given. In the table, γ represents a hydrogen atom when "-" appears in the γ column and this hydrogen atom appears in the α column or the β column.

TABLE 6

| Example | | | | | | | A | | |
|---|---|---|---|---|---|---|---|---|---|
| compound | $R^{601}$ | $R^{602}$ | $R^{603}$ | $R^{604}$ | $R^{605}$ | $R^{606}$ | α | β | γ |
| A601 | A | H | H | H | H | H | — | 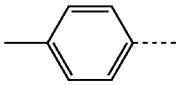 | ----$CH_2$—OH |
| A602 | A | H | H | H | H | H | — | 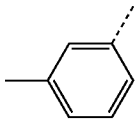 | ----$CH_2$—OH |

TABLE 6-continued

| Example compound | $R^{601}$ | $R^{602}$ | $R^{603}$ | $R^{604}$ | $R^{605}$ | $R^{606}$ | A α | A β | A γ |
|---|---|---|---|---|---|---|---|---|---|
| A603 | A | H | H | H | H | H | — | 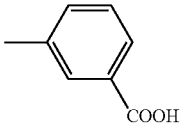 | — |
| A604 | A | H | H | H | H | H | — | 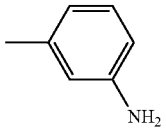 | — |
| A605 | A | H | H | H | H | H | — | 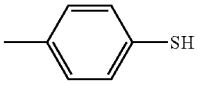 | — |
| A606 | A | H | H | H | H | H | 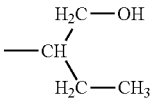 | — | — |
| A607 | A | H | H | H | H | H | 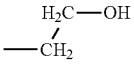 | — | — |
| A608 | A | H | H | H | H | H | — | — | COOH |
| A609 | A | H | H | H | H | H | — | — | NH2 |
| A610 | A | CN | H | H | H | H | — | — | NH2 |
| A611 | CN | CN | A | H | H | H | — | — | NH2 |
| A612 | A | H | H | H | H | H | — | — | OH |
| A613 | H | H | A | H | H | H | — | — | OH |
| A614 | CH3 | H | A | H | H | H | — | — | OH |
| A615 | H | H | A | H | H | A | — | — | OH |
| A616 | A | A | H | H | H | H | — | 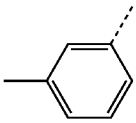 | ----$CH_2$—OH |
| A617 | A | A | H | H | H | H | 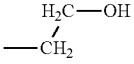 | — | — |
| A618 | A | A | H | H | H | H | 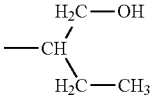 | — | — |
| A619 | A | A | H | H | H | H | COOH | — | — |

In Tables 7-1 and 7-2, specific examples of the compound represented by formula (A-7) are given. In the tables, γ represents a hydrogen atom when "-" appears in the γ column and this hydrogen atom appears in the α column or the β column.

TABLE 7-1

| Example compound | $R^{701}$ | $R^{702}$ | $R^{703}$ | $R^{704}$ | $R^{705}$ | $R^{706}$ | $R^{707}$ | $R^{708}$ | A α | A β | A γ |
|---|---|---|---|---|---|---|---|---|---|---|---|
| A701 | A | H | H | H | H | H | H | H | — | 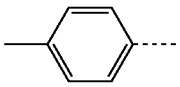 | ----$CH_2$—OH |

TABLE 7-1-continued
| Example compound | $R^{701}$ | $R^{702}$ | $R^{703}$ | $R^{704}$ | $R^{705}$ | $R^{706}$ | $R^{707}$ | $R^{708}$ | A α | A β | A γ |
|---|---|---|---|---|---|---|---|---|---|---|---|
| A702 | A | H | H | H | H | H | H | H | — | 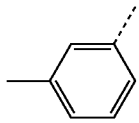 | ----$CH_2$—OH |
| A703 | A | H | H | H | H | H | H | $NO_2$ | — | 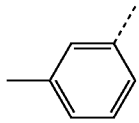 | ----$CH_2$—OH |
| A704 | A | H | H | H | H | H | H | H | — | 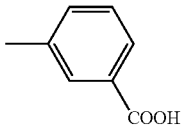 | — |
| A705 | A | H | H | H | H | H | H | H | — | 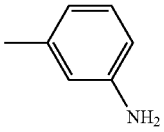 | — |
| A706 | A | H | H | H | H | H | H | H | — | 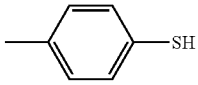 | — |
| A707 | A | H | H | H | H | H | H | H | 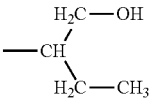 | — | — |
| A708 | A | H | H | H | H | H | H | H | — | — | COOH |
| A709 | A | H | H | H | 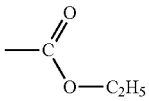 | H | H | H | — | — | COOH |
| A710 | A | H | H | H | A | H | H | H | — | 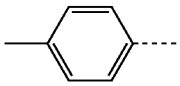 | ----$CH_2$—OH |
| A711 | A | H | H | H | A | H | H | H | — | 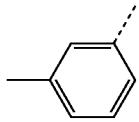 | ----$CH_2$—OH |
| A712 | A | H | H | $NO_2$ | A | H | H | $NO_2$ | — | 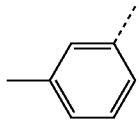 | ----$CH_2$—OH |
| A713 | A | H | F | H | A | H | F | H | — | 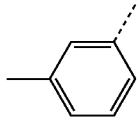 | ----$CH_2$—OH |

TABLE 7-1-continued
| Example compound | $R^{701}$ | $R^{702}$ | $R^{703}$ | $R^{704}$ | $R^{705}$ | $R^{706}$ | $R^{707}$ | $R^{708}$ | A α | A β | A γ |
|---|---|---|---|---|---|---|---|---|---|---|---|
| A714 | A | H | H | H | A | H | H | H | — | 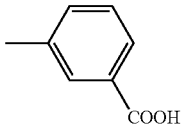 | — |
| A715 | A | H | H | H | A | H | H | H | — | 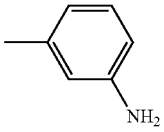 | — |
20
TABLE 7-2
| | | | | | | | | | | | |
|---|---|---|---|---|---|---|---|---|---|---|---|
| A716 | A | H | H | H | A | H | H | H | — | 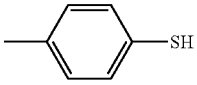 | — |
| A717 | A | H | H | H | A | H | H | H | 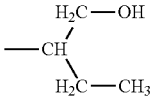 | — | — |
| A718 | A | H | H | H | A | H | H | H | — | — | COOH |
| A719 | H | A | H | H | H | A | H | H | — | — | COOH |
| A720 | A | H | H | H | A | F | H | H | — | — | COOH |
| A721 | A | H | H | $CH_3$ | $CH_3$ | H | H | H | — | — | COOH |
| A722 | A | H | H | $C_4H_9$ | $C_4H_9$ | H | H | H | — | — | COOH |
| A723 | A | H | H | 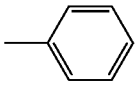 | 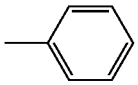 | H | H | H | — | — | COOH |
| A724 | A | H | H | $CH_3$ | $CH_3$ | H | H | H | — | 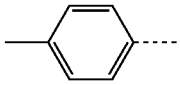 | ----$CH_2$—OH |
| A725 | A | H | H | $C_4H_9$ | $C_4H_9$ | H | H | H | — | 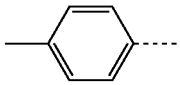 | ----$CH_2$—OH |
| A726 | A | H | H | 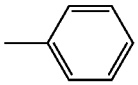 | 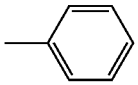 | H | H | H | — | 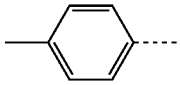 | ----$CH_2$—OH |
| A727 | A | H | H | $C_4H_9$ | $C_4H_9$ | H | H | H | — | 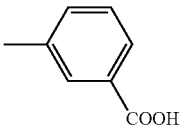 | — |
| A728 | A | H | H | $C_4H_9$ | $C_4H_9$ | H | H | H | — | 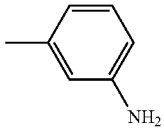 | — |

TABLE 7-2-continued

| | | | | | | | | | | | | |
|---|---|---|---|---|---|---|---|---|---|---|---|---|
| A729 | A | H | H | $C_4H_9$ | $C_4H_9$ | H | H | H | — | 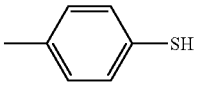 | — |

In Tables 8-1 and 8-2, specific examples of the compound represented by formula (A-8) are given. In the tables, γ represents a hydrogen atom when "-" appears in the γ column and this hydrogen atom appears in the α column or the β column.

TABLE 8-1

| Example compound | $R^{801}$ | $R^{802}$ | $R^{803}$ | $R^{804}$ | $R^{805}$ | $R^{806}$ | $R^{807}$ | $R^{808}$ | $R^{809}$ | $R^{810}$ | A α | A β | A γ |
|---|---|---|---|---|---|---|---|---|---|---|---|---|---|
| A801 | H | H | H | H | H | H | H | H | 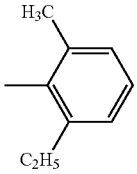 | A | 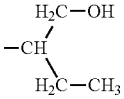 | — | — |
| A802 | H | H | H | H | H | H | H | H | 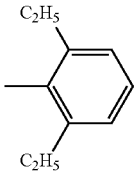 | A | 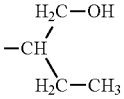 | — | — |
| A803 | H | H | H | H | H | H | H | H | 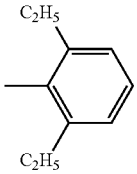 | A | — | 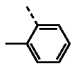 | 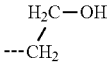 |
| A804 | H | H | H | H | H | H | H | H | 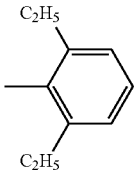 | A | — | 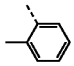 | 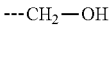 |
| A805 | H | H | H | H | H | H | H | H | 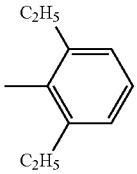 | A | — | 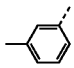 | 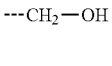 |
| A806 | H | H | H | H | H | H | H | H | 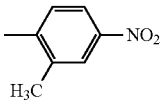 | A | 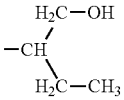 | — | — |
| A807 | H | H | H | H | H | H | H | H | 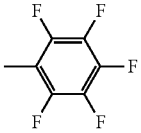 | A | 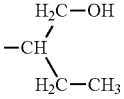 | — | — |

TABLE 8-1-continued
| Example compound | $R^{801}$ | $R^{802}$ | $R^{803}$ | $R^{804}$ | $R^{805}$ | $R^{806}$ | $R^{807}$ | $R^{808}$ | $R^{809}$ | $R^{810}$ | A α | A β | A γ |
|---|---|---|---|---|---|---|---|---|---|---|---|---|---|
| A808 | H | H | H | H | H | H | H | H | 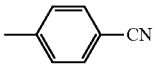 | A | 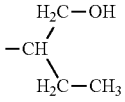 | — | — |
| A809 | H | H | H | H | H | H | H | H | 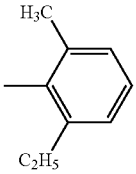 | A | $—C_5H_{10}—OH$ | — | — |
| A810 | H | H | H | H | H | H | H | H | $—C_6H_{13}$ | A | 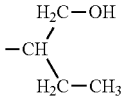 | — | — |
| A811 | H | H | H | H | H | H | H | H | 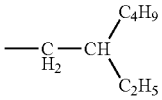 | A | — | 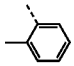 | 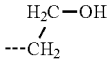 |
| A812 | H | H | H | H | H | H | H | H | 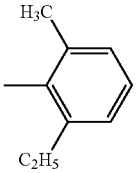 | A | — | 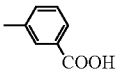 | — |
| A813 | H | H | H | H | H | H | H | H | 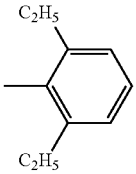 | A | — | 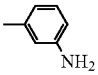 | — |
| A814 | H | H | H | H | H | H | H | H | 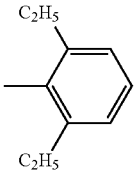 | A | — | 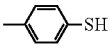 | — |
| A815 | H | H | H | H | H | H | H | H | 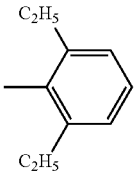 | A | — | 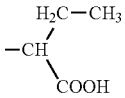 | — |

TABLE 8-2

| | | | | | | | | | | | | | |
|---|---|---|---|---|---|---|---|---|---|---|---|---|---|
| A816 | H | H | H | H | H | H | H | H | $C_2H_5$ 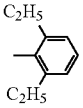 $C_2H_5$ | A | — | —C(H$_2$)—COOH | — |
| A817 | H | H | H | H | H | H | H | H | $C_2H_5$ 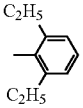 $C_2H_5$ | A | — | 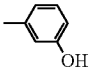 OH | — |
| A818 | H | H | H | H | H | H | H | H | $C_2H_5$ 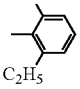 $C_2H_5$ | A | — | 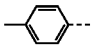 | ---C(H$_2$)—COOH |
| A819 | H | CN | H | H | H | H | CN | H | $H_3C$ 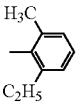 $C_2H_5$ | A | $H_2C$—OH 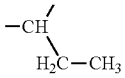 $H_2C$—$CH_3$ | — | — |
| A820 | H | 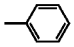 | H | H | H | H | 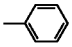 | H | $H_3C$ 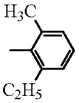 $C_2H_5$ | A | $H_2C$—OH 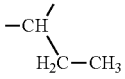 $H_2C$—$CH_3$ | — | — |
| A821 | H | A | H | H | H | H | H | H | $H_3C$ 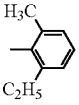 $C_2H_5$ | $H_3C$ 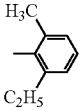 $C_2H_5$ | — | — | —COOH |
| A822 | H | Cl | Cl | H | H | Cl | Cl | H | $H_3C$ 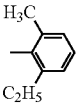 $C_2H_5$ | A | $H_2C$—OH 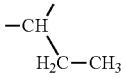 $H_2C$—$CH_3$ | — | — |
| A823 | H | H | H | H | H | H | H | H | $H_3C$ 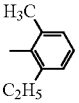 $C_2H_5$ | A | $H_2C$—OH 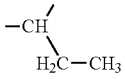 $H_2C$—$CH_3$ | — | — |
| A824 | H | H | H | H | H | H | H | H | A | A | $H_2C$—OH 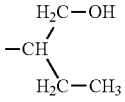 $H_2C$—$CH_3$ | — | — |
| A825 | H | H | H | H | H | H | H | H | A | A | — | 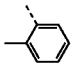 | $H_2C$—OH 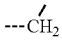 ---$CH_2$ |
| A826 | H | H | H | H | H | H | H | H | A | A | — | 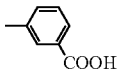 COOH | — |
| A827 | H | H | H | H | H | H | H | H | A | A | — | 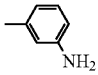 $NH_2$ | — |
| A828 | H | H | H | H | H | H | H | H | A | A | — | 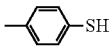 SH | — |
| A829 | H | H | H | H | H | H | H | H | A | A | — | $H_2C$—$CH_3$ 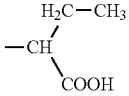 COOH | — |
| A830 | H | H | H | H | H | H | H | H | A | A | — | 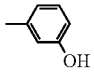 OH | — |

TABLE 8-2-continued

| | | | | | | | | | | | | | |
|---|---|---|---|---|---|---|---|---|---|---|---|---|---|
| A831 | H | 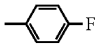 | H | H | H | H | 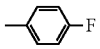 | H | $C_2H_5$ 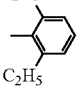 $C_2H_5$ | A | — | 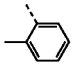 | $H_2C$—OH / ---$CH_2$ |

Among these Example Compounds, a compound A124 (an imide compound represented by formula (21) below), a compound A135 (an imide compound represented by formula (22) below), a compound A153 (an imide compound represented by formula (23) below), and a compound A173 (an imide compound represented by formula (24) below) are novel imide compounds that have an excellent effect of suppressing positive ghosting.

(21)

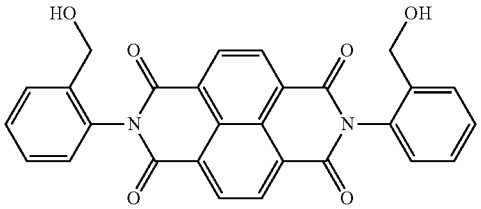

(22)

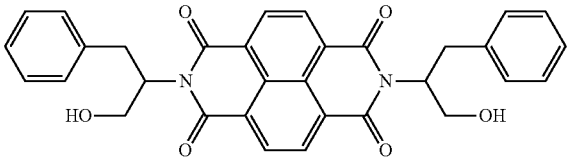

(23)

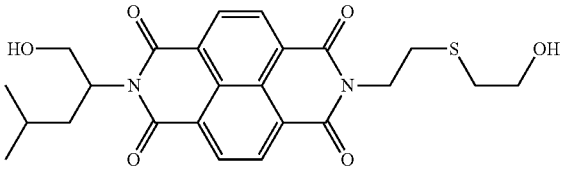

(24)

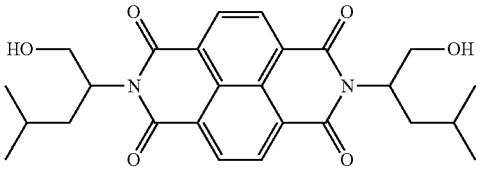

A derivative (derivative of the electron transporting substance) having the structure represented by (A1) can be synthesized by, for example, any of known synthetic methods described in U.S. Pat. Nos. 4,442,193, 4,992,349, and 5,468,583 and Chemistry of materials, Vol. 19, No. 11, 2703-2705 (2007). It can also be synthesized through a reaction between a naphthalenetetracarboxylic dianhydride and a monoamine derivative available from Tokyo Chemical Industry Co., Ltd., Sigma-Aldrich Japan K.K., and Johnson Matthey Japan Incorporated.

The compound represented by (A1) has polymerizable functional groups (a hydroxy group, a thiol group, an amino group, and a carboxyl group) that can polymerize with isocyanate groups of the isocyanate compound. Examples of the method for introducing these groups into the derivative having the structure (A1) include a method with which the polymerizable functional groups are directly introduced into a derivative having the structure (A1) and a method with which structures that have the polymerizable functional groups or functional groups that can serve as precursors of the polymerizable functional groups are introduced to the derivative. Examples of the latter method include a method for introducing a functional group-containing aryl group through a cross coupling reaction of a halide of a naphthylimide derivative and a base in the presence of a palladium catalyst, a method for introducing a functional group-containing alkyl group through a cross coupling reaction between the halide and a base in the presence of an $FeCl_3$ catalyst, and a method for introducing a hydroxyalkyl group or a carboxyl group through allowing an epoxy compound, $CO_2$, or the like to act on a lithiated halide. A naphthalenetetracarboxylic dianhydride derivative or monoamine derivative having the polymerizable functional groups described above or functional groups that can serve as precursors of the polymerizable functional groups may be used as the raw material for synthesizing the naphthylimide derivative.

The derivative having the structure (A2) is available as reagents from Tokyo Chemical Industry Co., Ltd., Sigma-Aldrich Japan K.K., and Johnson Matthey Japan Incorporated, for example. The derivative having the structure (A2) can also be synthesized by synthetic methods disclosed in Chem. Educator No. 6, 227-234 (2001), Journal of Synthetic Organic Chemistry, Japan, vol. 15, 29-32 (1957), and Journal of Synthetic Organic Chemistry, Japan, vol. 15, 32-34 (1957) based on a phenanthrene derivative or a phenanthroline derivative. A dicyanomethylene group may be introduced through a reaction with a malononitrile.

The compound represented by (A2) has polymerizable functional groups (a hydroxy group, a thiol group, an amino group, and a carboxyl group) that can polymerize with isocyanate groups of the isocyanate compound. Examples of the method for introducing these polymerizable functional groups into the derivative having the structure (A2) include a method with which the polymerizable functional groups are directly introduced to the derivative having the structure (A2) after synthesis of the derivative and a method with which structures that have the polymerizable functional groups or functional groups that serve as precursors of the polymerizable functional groups are introduced to the derivative after the synthesis. Examples of the latter method include a method for introducing a functional group-containing aryl group through a cross coupling reaction of a halide of phenanthrenequinone and a base in the presence of a palladium catalyst, a method for introducing a functional group-containing alkyl group through a cross coupling reaction between the halide and a base in the presence of an $FeCl_3$ catalyst, and a method for introducing a hydroxyalkyl group or a carboxyl group through allowing an epoxy compound, $CO_2$, or the like to act on a lithiated halide.

The derivative having the structure (A3) is available as reagents from Tokyo Chemical Industry Co., Ltd., Sigma-Aldrich Japan K.K., and Johnson Matthey Japan Incorporated, for example. The derivative having the structure (A3)

can also be synthesized by a synthetic method disclosed in Bull. Chem. Soc. Jpn., Vol. 65, 1006-1011 (1992), based on a phenanthrene derivative or a phenanthroline derivative. A dicyanomethylene group may be introduced through a reaction with a malononitrile.

The compound represented by (A3) has polymerizable functional groups (a hydroxy group, a thiol group, an amino group, and a carboxyl group) that can polymerize with isocyanate groups of the isocyanate compound. Examples of the method for introducing these polymerizable functional groups into the derivative having the structure (A3) include a method with which the polymerizable functional groups are directly introduced to the derivative having the structure (A3) after synthesis of the derivative and a method with which structures that have the polymerizable functional groups or functional groups that serve as precursors of the polymerizable functional groups are introduced to the derivative after the synthesis. Examples of the latter method include a method for introducing a functional group-containing aryl group through a cross coupling reaction of a halide of phenanthrolinequinone and a base in the presence of a palladium catalyst, a method for introducing a functional group-containing alkyl group through a cross coupling reaction between the halide and a base in the presence of an $FeCl_3$ catalyst, and a method for introducing a hydroxyalkyl group or a carboxyl group through allowing an epoxy compound, $CO_2$, or the like to act on a lithiated halide.

The derivative having the structure (A4) is available as reagents from Tokyo Chemical Industry Co., Ltd., Sigma-Aldrich Japan K.K., and Johnson Matthey Japan Incorporated, for example. The derivative having the structure (A4) can also be synthesized by synthetic methods disclosed in Tetrahedron Letters, 43 (16), 2991-2994 (2002) and Tetrahedron Letters, 44 (10), 2087-2091 (2003), based on an acenaphthenequinone derivative. A dicyanomethylene group may be introduced through a reaction with a malononitrile.

The compound represented by (A4) has polymerizable functional groups (a hydroxy group, a thiol group, an amino group, and a carboxyl group) that can polymerize with isocyanate groups of the isocyanate compound. Examples of the method for introducing these polymerizable functional groups into the derivative having the structure (A4) include a method with which the polymerizable functional groups are directly introduced to the derivative having the structure (A4) after synthesis of the derivative and a method with which structures that have the polymerizable functional groups or functional groups that serve as precursors of the polymerizable functional groups are introduced to the derivative after the synthesis. Examples of the latter method include a method for introducing a functional group-containing aryl group through a cross coupling reaction of a halide of acenaphthenequinone and a base in the presence of a palladium catalyst, a method for introducing a functional group-containing alkyl group through a cross coupling reaction between the halide and a base in the presence of an $FeCl_3$ catalyst, and a method for introducing a hydroxyalkyl group or a carboxyl group through allowing an epoxy compound, $CO_2$, or the like to act on a lithiated halide.

The derivative having the structure (A5) is available as reagents from Tokyo Chemical Industry Co., Ltd., Sigma-Aldrich Japan K.K., and Johnson Matthey Japan Incorporated, for example. The derivative having the structure (A5) can also be synthesized by a synthetic method disclosed in U.S. Pat. No. 4,562,132 by using a fluorenone derivative and malononitrile. Alternatively, the derivative may be made by synthetic methods disclosed in Japanese Patent Laid-Open Nos. 5-279582 and 7-70038 by using a fluorenone derivative and an aniline derivative.

The compound represented by (A5) has polymerizable functional groups (a hydroxy group, a thiol group, an amino group, and a carboxyl group) that can polymerize with isocyanate groups of the isocyanate compound. Examples of the method for introducing these polymerizable functional groups into the derivative having the structure (A5) include a method with which the polymerizable functional groups are directly introduced to the derivative having the structure (A5) and a method with which structures that have the polymerizable functional groups or functional groups that serve as precursors of the polymerizable functional groups are introduced to the derivative. Examples of the latter method include a method for introducing a functional group-containing aryl group through a cross coupling reaction of a halide of fluorenone and a base in the presence of a palladium catalyst, a method for introducing a functional group-containing alkyl group through a cross coupling reaction between the halide and a base in the presence of an $FeCl_3$ catalyst, and a method for introducing a hydroxyalkyl group or a carboxyl group through allowing an epoxy compound, $CO_2$, or the like to act on a lithiated halide.

The derivative having the structure (A6) can be synthesized by, for example, synthetic methods disclosed in Chemistry Letters, 37 (3), 360-361 (2008) and Japanese Patent Laid-Open No. 9-151157. The derivative having the structure (A6) is also available as reagents from Tokyo Chemical Industry Co., Ltd., Sigma-Aldrich Japan K.K., and Johnson Matthey Japan Incorporated, for example.

The compound represented by (A6) has polymerizable functional groups (a hydroxy group, a thiol group, an amino group, and a carboxyl group) that can polymerize with isocyanate groups of the isocyanate compound. Examples of the method for introducing these polymerizable functional groups into the derivative having the structure (A6) include a method with which structures that have the polymerizable functional groups or functional groups that serve as precursors of the polymerizable functional groups are introduced to the derivative having the structure (A6). Examples of this method include a method for introducing a functional group-containing aryl group through a cross coupling reaction of a halide of naphthoquinone and a base in the presence of a palladium catalyst, a method for introducing a functional group-containing alkyl group through a cross coupling reaction between the halide and a base in the presence of an $FeCl_3$ catalyst, and a method for introducing a hydroxyalkyl group or a carboxyl group through allowing an epoxy compound, $CO_2$, or the like to act on a lithiated halide.

The derivative having the structure (A7) can be synthesized by, for example, synthetic methods disclosed in Japanese Patent Laid-Open No. 1-206349 and PPCI/Japan Hard Copy '98 Proceedings, p. 207 (1998). For example, synthesis may be conducted by using, as a raw material, a phenol derivative available as reagents from Tokyo Chemical Industry Co., Ltd., or Sigma-Aldrich Japan K.K.

The compound represented by (A7) has polymerizable functional groups (a hydroxy group, a thiol group, an amino group, and a carboxyl group) that can polymerize with isocyanate groups of the isocyanate compound. Examples of the method for introducing these polymerizable functional groups into the derivative having the structure (A7) include a method with which structures that have the polymerizable functional groups or functional groups that serve as precursors of the polymerizable functional groups are introduced to the derivative. Examples of this method include a method for introducing a functional group-containing aryl group through a cross coupling reaction of a halide of diphenoquinone and a base in the presence of a palladium catalyst, a method for introducing a functional group-containing alkyl group through a cross coupling reaction between the halide and a base in the presence of an $FeCl_3$ catalyst, and a method for introducing a hydroxyalkyl group or a carboxyl group through allowing an epoxy compound, $CO_2$, or the like to act on a lithiated halide.

The derivative having the structure (A8) can be synthesized by, for example, a known synthetic method disclosed in Journal of the American chemical society, Vol. 129, No. 49, 15259-78 (2007). The derivative can also be synthesized through a reaction between a perylenetetracarboxylic dianhydride and a monoamine derivative available as reagents from Tokyo Chemical Industry Co., Ltd., Sigma-Aldrich Japan K.K., and Johnson Matthey Japan Incorporated.

The compound represented by (A8) has polymerizable functional groups (a hydroxy group, a thiol group, an amino group, and a carboxyl group) that can polymerize with isocyanate groups of the isocyanate compound. Examples of the method for introducing these polymerizable functional groups into the derivative having the structure (A8) include a method with which the polymerizable functional groups are directly introduced to the derivative having the structure (A8) and a method with which structures that have the polymerizable functional groups or functional groups that serve as precursors of the polymerizable functional groups are introduced to the derivative. Examples of the latter method include a method including performing a cross coupling reaction of a halide of a perylene imide derivative and a base in the presence of a palladium catalyst and a method including performing a cross coupling reaction between the halide and a base in the presence of an $FeCl_3$ catalyst. A perylenetetracarboxylic dianhydride derivative or monoamine derivative having the polymerizable functional groups or functional groups that can serve as precursors of the polymerizable functional groups can be used as a raw material for synthesizing the perylene imide derivative.

Isocyanate Compound

The isocyanate compound used in the present invention may be any compound that has three to six groups selected from isocyanate groups (NCO groups) and blocked isocyanate groups ($NHCOX^1$ groups) and has a molecular weight of 200 or more and 1300 or less. Examples of the isocyanate compound used in the present invention include various modified products, e.g., isocyanurate-modified products, biuret-modified products, allophanate-modified products, and trimethylolpropane adducts, of diisocyanates such as triisocyanate benzene, triphenylmethane triisocyanate, lysine triisocyanate, tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanate hexanoate, and norbornene diisocyanate.

The isocyanate compound of the present invention may have a cyclic structure. A cyclic structure further suppresses aggregation of the resin molecular chains and localization of the electron transporting substance and thus a higher ghosting suppressing effect is exhibited. The isocyanate compound may have an isocyanurate structure shown below:

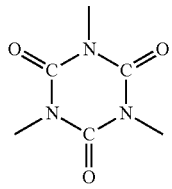

These isocyanate compounds may be compounds blocked with a blocking group ($X^1$) in the blocked isocyanate group (—$NHCOX^1$ group). $X^1$ is a group represented by any one of formulae (1) to (7) below.

(1)

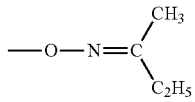

(2)

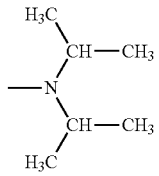

(3)

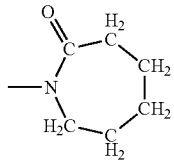

(4)

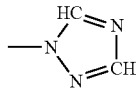

(5)

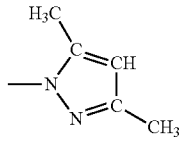

(6)

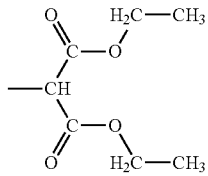

(7)

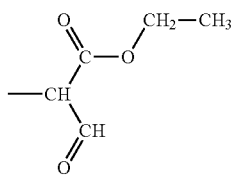

Specific examples of the isocyanate compounds are as follows.

(I-1)
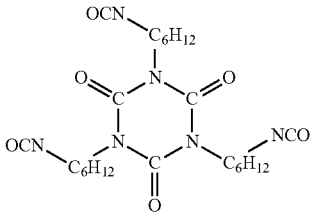
(I-2)
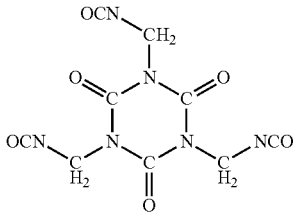
(I-3)
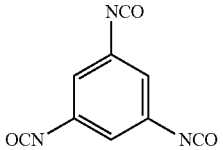
(I-4)
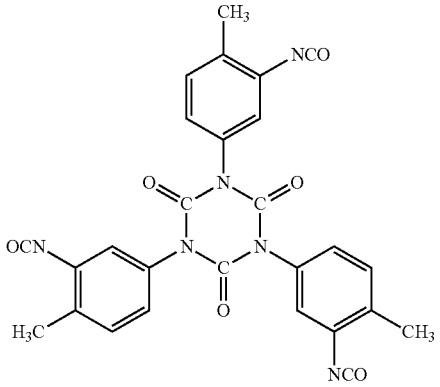
(I-5)
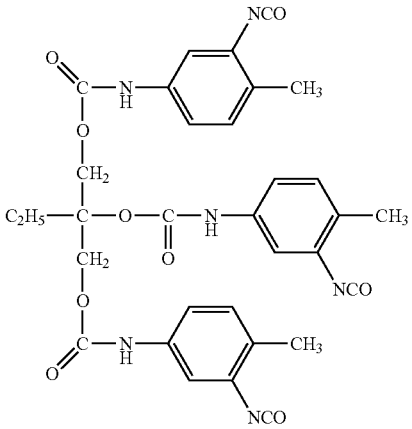
(I-6)
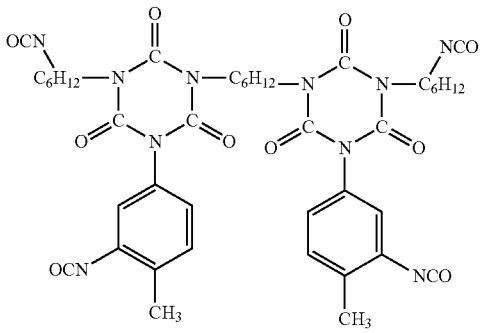
(I-7)
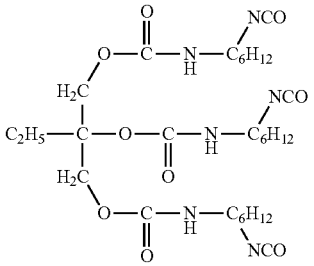
(I-8)
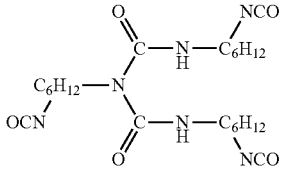

-continued
(I-9)
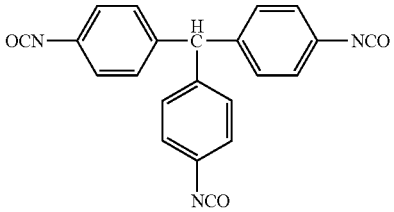
(I-10)
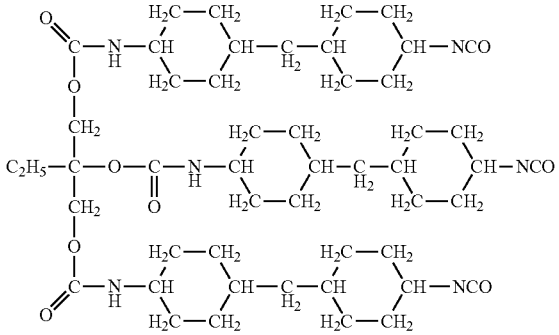
(I-11)
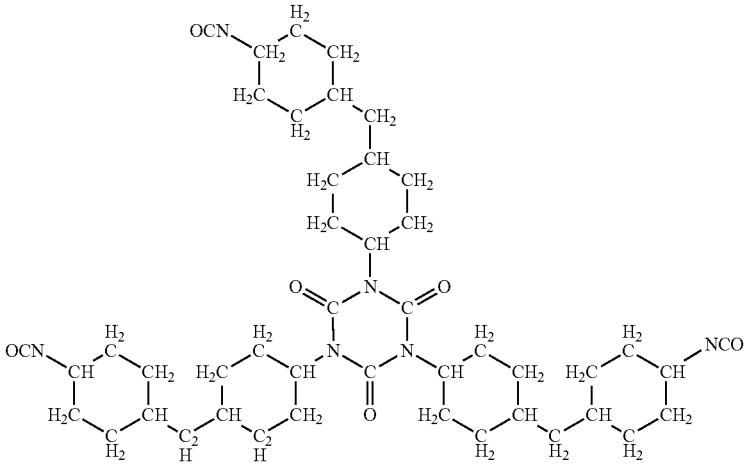
(I-12)
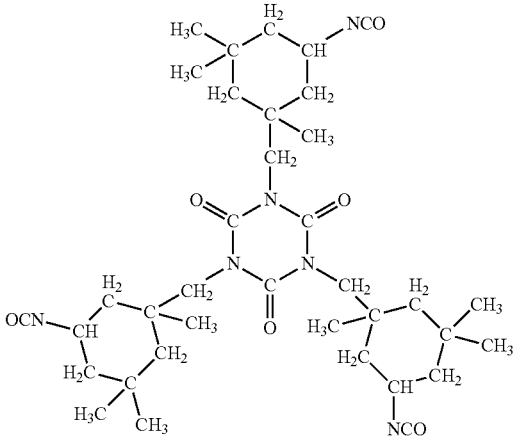
(I-13)
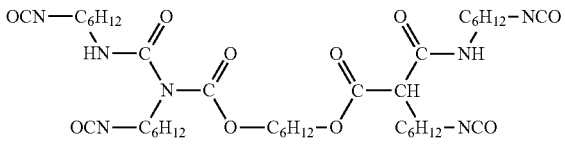

-continued
(I-14)
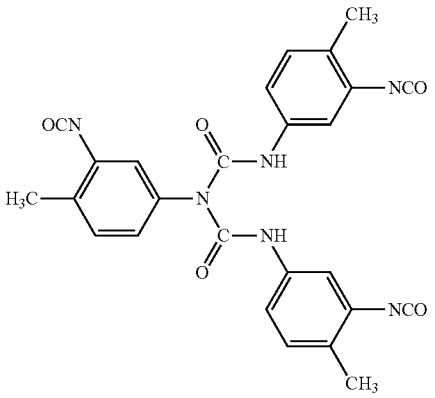
(I-15)
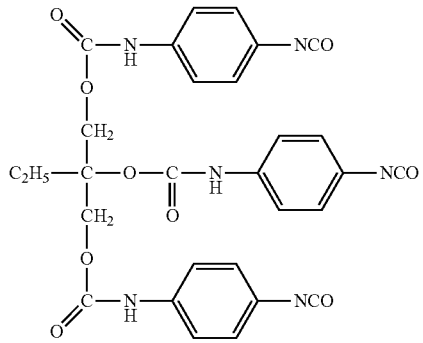
(I-16)
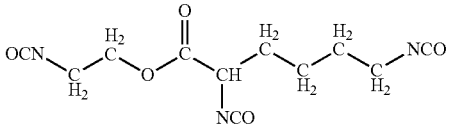
(I-17)
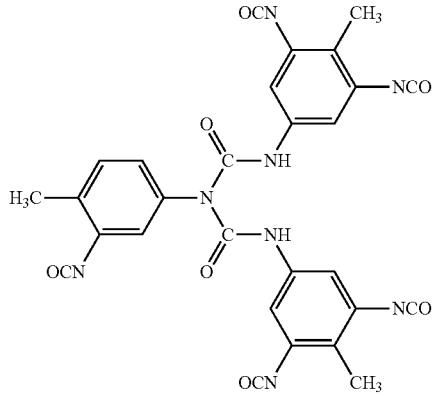
(I-18)
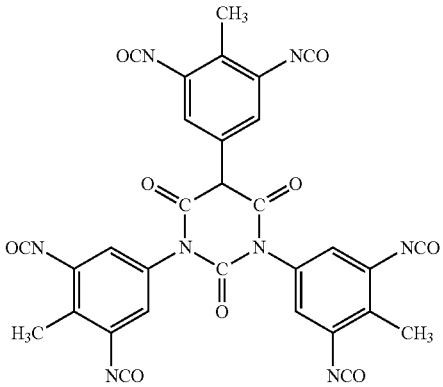
(I-19)
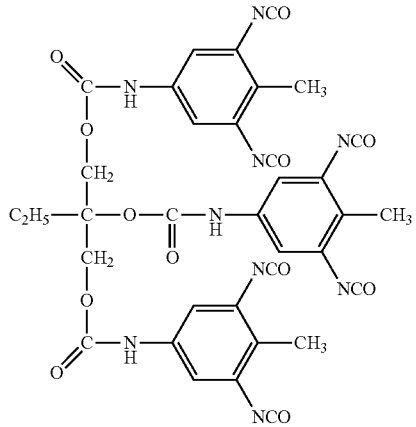
(I-20)
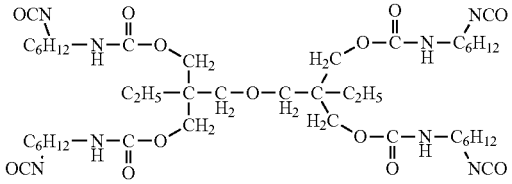
(I-21)
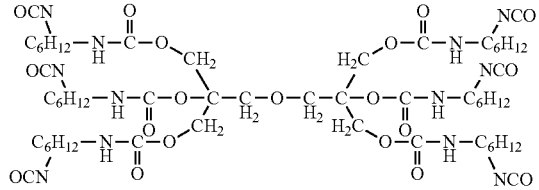
(I-22)
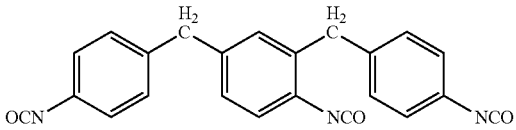

-continued (I-23)

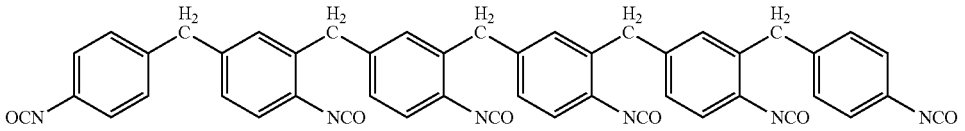

BL3175, BL3475, and BL3575, for example, available from Sumika Bayer Urethane Co., Ltd., may also be used as the isocyanate compound.

Resin

A resin having a repeating unit represented by formula (B) above is obtained by, for example, polymerizing a monomer that has polymerizable functional groups (a hydroxy group, a thiol group, an amino group, and a carboxyl group) available as reagents from Sigma-Aldrich Japan K.K.

Alternatively, the resin may be purchased. Examples of the commercially available resin include polyether polyol resins such as AQD-457 and AQD-473 produced by Nippon Polyurethane Industry Co., Ltd., and SANNIX GP-400 and GP-700 produced by Sanyo Chemical Industries, Ltd., polyester polyol resins such as PHTHALKYD W2343 produced by Hitachi Chemical Co., Ltd., WATERSOL S-118 and CD-520 produced by DIC Corporation, and HARIDIP WH-1188 produced by Harima Chemicals Group, Inc., polyacryl polyol resins such as BURNOCK WE-300 and WE-304 produced by DIC Corporation, polyvinyl alcohol resins such as Kuraray POVAL PVA-203 produced by Kuraray Co., Ltd., polyvinyl acetal resins such KW-1 and KW-3, BX-1, BM-1, KS-1, and KS-5 produced by Sekisui Chemical Co., Ltd., polyamide resins such as TORESIN FS-350 produced by Nagase Chemtex Corporation, carboxyl group-containing resins such as AQUALIC produced by Nippon Shokubai Co., Ltd., and FINLEX SG2000 produced by Namariichi Co., Ltd., polyamines such as LUCKAMIDE produced by DIC Corporation, and polythiols such as QE-340M produced by Toray Industries Inc.

Specific examples of the resin having a repeating unit represented by formula (B) above are shown in Table 9.

TABLE 9

| | Structure | | | No. of moles of functional | Other | Molecular |
|---|---|---|---|---|---|---|
| | Y1 | Y2 | W | group per gram | segment | weight |
| B1 | H | Single bond | OH | 3.3 mmol | Butyral | $1 \times 10^5$ |
| B2 | H | Single bond | OH | 3.3 mmol | Butyral | $4 \times 10^4$ |
| B3 | H | Single bond | OH | 3.3 mmol | Butyral | $2 \times 10^4$ |
| B4 | H | Single bond | OH | 1.0 mmol | Polyolefin | $1 \times 10^5$ |
| B5 | H | Single bond | OH | 3.0 mmol | Ester | $8 \times 10^4$ |
| B6 | H | Single bond | OH | 2.5 mmol | Polyether | $5 \times 10^4$ |
| B7 | H | Single bond | OH | 2.8 mmol | Cellulose | $3 \times 10^4$ |
| B8 | H | Single bond | COOH | 3.5 mmol | Polyolefin | $6 \times 10^4$ |
| B9 | H | Single bond | $NH_2$ | 1.2 mmol | Polyamide | $2 \times 10^5$ |
| B10 | H | Single bond | SH | 1.3 mmol | Polyolefin | $8 \times 10^3$ |
| B11 | H | Phenylene | OH | 2.8 mmol | Polyolefin | $6 \times 10^4$ |
| B12 | H | Single bond | OH | 3.0 mmol | Butyral | $7 \times 10^4$ |
| B13 | H | Single bond | OH | 2.9 mmol | Polyester | $2 \times 10^4$ |
| B14 | H | Single bond | OH | 2.5 mmol | Polyester | $6 \times 10^3$ |
| B15 | H | Single bond | OH | 2.7 mmol | Polyester | $8 \times 10^4$ |
| B16 | H | Single bond | COOH | 1.4 mmol | Polyolefin | $2 \times 10^5$ |
| B17 | H | Single bond | COOH | 2.2 mmol | Polyester | $9 \times 10^3$ |
| B18 | H | Single bond | COOH | 2.8 mmol | Polyester | $8 \times 10^2$ |
| B19 | CH3 | Single bond | OH | 2.0 mmol | Polyester | $5 \times 10^3$ |
| B20 | C2H5 | Single bond | OH | 1.2 mmol | Polyolefin | $6 \times 10^2$ |
| B21 | H | Single bond | OH | 3.3 mmol | Butyral | $2.7 \times 10^5$ |
| B22 | H | Single bond | OH | 3.3 mmol | Butyral | $4 \times 10^5$ |
| B23 | H | Single bond | OH | 2.5 mmol | Acetal | $4 \times 10^5$ |

The compounds of the present invention etc., were characterized by the following methods.

Mass Spectroscopy (MS)

The molecular weight was measured with a mass spectrometer (MALDI-TOF MS, ultraflex produced by Bruker Daltonics K.K.) at an acceleration voltage of 20 kV in reflector mode with fullerene C60 as a molecular weight standard. The peak top value observed was confirmed.

Nuclear Magnetic Resonance (NMR) Analysis

The structure was confirmed through $^{1}$H-NMR and $^{13}$C-NMR analysis (FT-NMR, JNM-EX400 model produced by JEOL Ltd.) in 1,1,2,2-tetrachloroethane (d2) or dimethyl sulfoxide (d6) at 120° C.

Gel Permeation Chromatography (GPC)

GPC was conducted with a gel permeation chromatograph HLC-8120 produced by Tosoh Corporation using polystyrene standards.

A coating film was formed by using an undercoat layer coating solution containing an isocyanate compound, a resin, and an electron transporting substance and dried by heating to obtain an undercoat layer. The undercoat layer was immersed in cyclohexanone and the weight of the undercoat layer before and after the immersion was confirmed. It was confirmed that elution of the components in the undercoat layer did not occur by immersion and that the undercoat layer was cured (polymerized).

Photosensitive Layer

A photosensitive layer is formed on the undercoat layer.

Examples of the charge generating substance include azo pigments, perylene pigments, anthraquinone derivatives, anthanthrone derivative, dibenzpyrenequinone derivatives, pyranthrone derivatives, violanthrone derivatives, isoviolanthrone derivatives, indigo derivatives, thioindigo derivatives, phthalocyanine pigments such as metal phthalocyanine and metal-free phthalocyanine, and bisbenzimidazole derivatives. Among these, azo pigments and phthalocyanine pigments are preferable. Among phthalocyanine pigments, oxytitanium phthalocyanine, chlorogallium phthalocyanine, and hydroxygallium phthalocyanine are preferable.

The photosensitive layer may be a layered photosensitive layer. In such a case, examples of the binder resin used in the charge generating layer include polymers and copolymers of vinyl compounds such as styrenes, vinyl acetate, vinyl chloride, acrylates, methacrylates, vinylidene fluoride, and trifluoroethylene, polyvinyl alcohol resins, polyvinyl acetal resins, polycarbonate resins, polyester resins, polysulfone resins, polyphenylene oxide resins, polyurethane resins, cellulose resins, phenolic resins, melamine resins, silicon resins, and epoxy resins. Among these, polyester resins, polycarbonate resins, and polyvinyl acetal resins are preferred and polyvinyl acetal resins are more preferred.

The ratio of the charge generating substance to the binder resin in the charge generating layer (charge generating substance/binder resin) is preferably in the range of 10/1 to 1/10 and more preferably in the range of 5/1 to 1/5. The thickness of the charge generating layer may be 0.05 μm or more and 5 μm or less. Examples of the solvent used for preparing the coating solution for forming the charge generating layer include alcohol-based solvents, sulfoxide-based solvents, ketone-based solvents, ether-based solvents, ester-based solvents, and aromatic hydrocarbon solvents.

Examples of the charge transport substance (hole transporting substance) include polycyclic aromatic compounds, heterocyclic compounds, hydrazone compounds, styryl compounds, benzidine compounds, triarylamine compounds, and triphenylamine; and polymers that have a main chain or side chain containing a group derived from any of these compounds.

In the cases where the photosensitive layer is a layered photosensitive layer, the binder resin used in the charge transporting layer (hole transporting layer) may be a polyester resin, a polycarbonate resin, a polymethacrylate resin, a polyarylate resin, a polysulfone resin, or a polystyrene resin, for example. The binder resin is more preferably a polycarbonate resin or a polyarylate resin. The weight-average molecular weight (Mw) of the resin may be in the range of 10,000 to 300,000.

The ratio of the charge transport substance to the binder resin in the charge transporting layer (charge transport substance/binder resin) is preferably in the range of 10/5 to 5/10 and more preferably in the range of 10/8 to 6/10. The thickness of the charge transporting layer may be 5 μm or more and 40 μm or less.

Another layer, such as a second undercoat layer, that does not contain the polymerized product of the present invention may be interposed between the support and the undercoat layer or between the undercoat layer and the photosensitive layer.

Examples of the solvent used in the coating solution for forming the charge transporting layer include alcohol-based solvents, sulfoxide-based solvents, ketone-based solvents, ether-based solvents, ester-based solvents, and aromatic hydrocarbon solvents.

A protective layer (surface protecting layer) that contains conductive particles or a hole transporting substance and a binder resin may be provided on the photosensitive layer (charge transporting layer). The protective layer may further contain additives such as a lubricant. Electrical conductivity or a hole transport property may be imparted to the binder resin of the protective layer. In such a case, there is no need to add conductive particles or a hole transporting substance other than the resin to the protective layer. The binder resin in the protective layer may be a thermoplastic resin or a curable resin curable with heat, light, or radiation (such as an electron beam).

The layers, such as an undercoat layer, a charge generating layer, and a charge transporting layer, that constitute the electrophotographic photosensitive member may be formed by dissolving and/or dispersing materials constituting the respective layers in respective solvents to obtain coating solutions, applying the coating solutions, and drying and/or curing the applied coating solutions. Examples of the method used for applying the coating solutions include a dip coating method, a spray coating method, a curtain coating method, and a spin coating method. Among these, a dip coating method is preferable from the viewpoints of efficiency and productivity.

Process Cartridge and Electrophotographic Apparatus

FIG. 1 is a schematic diagram of an example of an electrophotographic apparatus that includes a process cartridge that includes an electrophotographic photosensitive member according to the present invention.

Referring to FIG. 1, an electrophotographic photosensitive member 1 has a cylindrical shape and is rotated about a shaft 2 in the arrow direction at a particular peripheral speed. The surface (peripheral surface) of the electrophotographic photosensitive member 1 rotated is evenly charged to a particular positive or negative potential with a charging device 3 (a primary charging device such as a charging roller). Then the surface is exposed to exposure light (image exposure light) 4 from an exposure device (not shown) through, for example, slit exposure or laser beam scanning exposure. As a result, an electrostatic latent image corresponding to a desired image is formed on the surface of the electrophotographic photosensitive member 1.

The electrostatic latent image formed on the surface of the electrophotographic photosensitive member 1 is developed with a toner contained in a developing gent in a developing device 5 and forms a toner image. The toner image on the surface of the electrophotographic photosensitive member 1 is transferred to a transfer material (such as paper) P due to a transfer bias from a transferring device (such as transfer roller) 6. The transfer material P is picked up from a transfer material feeding unit (not shown in the drawing) and fed to the nip (contact portion) between the electrophotographic photosensitive member 1 and the transferring device 6 in synchronization with the rotation of the electrophotographic photosensitive member 1.

The transfer material P that received the transfer of the toner image is detached from the surface of the electrophotographic photosensitive member 1 and guided to a fixing unit 8 where the image is fixed. An image product (a print or a copy) is output from the apparatus.

The surface of the electrophotographic photosensitive member 1 after the transfer of the toner image is cleaned with a cleaning device (such as a cleaning blade) 7 to remove the developing agent (toner) that remains after the transfer. Then the charge is erased with pre-exposure light (not shown in the drawing) from a pre-exposure device (not shown in the drawing) so that the electrophotographic photosensitive member 1 can be repeatedly used for forming images. When the charging device 3 is of a contact-charging type such as a charging roller as shown in FIG. 1, the pre-exposure is not always necessary.

Two or more selected from the electrophotographic photosensitive member 1, the charging device 3, the developing device 5, the transferring device 6, the cleaning device 7, etc., may be housed in a container so as to form a process cartridge and the process cartridge may be configured to be removably loadable to the main unit of an electrophotographic apparatus such as a copy machine or a laser beam printer. In FIG. 1, the electrophotographic photosensitive member 1, the charging device 3, the developing device 5, and the cleaning device 7 are integrally supported to form a cartridge 9 which is detachably attachable to the main unit of the electrophotographic apparatus through a guiding unit 10 such as a rail of the main body of the electrophotographic apparatus.

EXAMPLES

The present invention will now be described in further detail through Examples. Note that the "parts" used in Examples means "parts by mass". First, synthetic examples of the electron transporting substances according to the present invention are described.

Synthetic Example 1

To 200 parts of dimethylacetamide, 5.4 parts of naphthalenetetracarboxylic dianhydride, 4 parts of 2-methyl-6-ethyl aniline, and 3 parts of 2-amino-1-butanol were added in a nitrogen atmosphere and stirring was conducted at room temperature for 1 hour to prepare a solution. The solution prepared was refluxed for 8 hours. Precipitates were filtered out and recrystallized in ethyl acetate. As a result, 1.0 parts of compound A101 was obtained.

Synthetic Example 2

To 200 parts of dimethylacetamide, 5.4 parts of naphthalenetetracarboxylic dianhydride (produced by Tokyo Chemical Industry Co., Ltd.) and 5 parts of 2-aminobutyric acid (produced by Tokyo Chemical Industry Co., Ltd.) were added in a nitrogen atmosphere and stirring was conducted at room temperature for 1 hour to prepare a solution. The solution prepared was refluxed for 8 hours. Precipitates were filtered out and recrystallized in ethyl acetate. As a result, 4.6 parts of compound A128 was obtained.

Synthetic Example 3

To 200 parts of dimethylacetamide, 5.4 parts of naphthalenetetracarboxylic dianhydride (produced by Tokyo Chemical Industry Co., Ltd.), 4.5 parts of 2,6-diethyl aniline (produced by Tokyo Chemical Industry Co., Ltd.), and 4 parts of 4-aminobenzenethiol were added in a nitrogen atmosphere and stirring was conducted at room temperature for 1 hour to prepare a solution. The solution prepared was refluxed for 8 hours. Precipitates were filtered out and recrystallized in ethyl acetate. As a result, 1.3 parts of compound A114 was obtained.

Synthetic Example 4

To 200 parts of dimethylacetamide and 1.8 parts of naphthalenetetracarboxylic dianhydride (produced by Tokyo Chemical Industry Co., Ltd.), 2.5 parts of 2-aminobenzyl alcohol (produced by Tokyo Chemical Industry Co., Ltd.) and 50 parts of dimethylacetamide were added in a nitrogen atmosphere at room temperature for 2 hours. Stirring was conducted at 40° C. for 1 hour and then at 120° C. for 1 hour. The resulting mixture was refluxed for 8 hours. After dimethylacetamide was removed by vacuum distillation, 100 parts of a methanol/water (1:1) solution was added to precipitate crystals. The crystals are filtered out, dissolved in an ethyl acetate/THF mixed solution, and fractionized through silica gel chromatography (eluent: ethyl acetate). The fraction containing the target substance was then condensed. The obtained crystals were recrystallized in an ethyl acetate/THF mixed solution. As a result, 1.6 parts of compound A124 (imide compound represented by formula (21)) was obtained.

Synthetic Example 5

To 200 parts of dimethylacetamide and 2.7 parts of naphthalenetetracarboxylic dianhydride (produced by Tokyo Chemical Industry Co., Ltd.), 3.6 parts of phenylalaninol (produced by Tokyo Chemical Industry Co., Ltd.) and 50 parts of dimethylacetamide were added in a nitrogen atmosphere. After stirring was conducted at 120° C. for 3 hours, refluxing was conducted for 5 hours. After dimethylacetamide was removed by vacuum distillation, 100 parts of water was added to precipitate crystals. The crystals are filtered out and recrystallized in ethanol. As a result, 3.1 parts of compound A135 (imide compound represented by formula (22)) was obtained.

Synthetic Example 6

In accordance with a synthetic method described in Chem. Educator No. 6, 227-234 (2001), 7.4 parts of 3,6-dibromo-9,10-phenanthrenedione was synthesized from 2.8 parts of 4-(hydroxymethyl)phenyl boric acid (produced by Aldrich) and phenanthrenequinone (produced by Sigma-Aldrich Japan) in a nitrogen atmosphere. To a mixed solvent containing 100 parts of toluene and 50 parts of ethanol, 7.4 parts of 3,6-dibromo-9,10-phenanthrenedione was added, and 100 parts of a 20% aqueous sodium carbonate solution was added dropwise to the resulting mixture. Then 0.55 parts of tetrakis (triphenylphosphine)palladium(0) was added and refluxing was conducted for 2 hours. After completion of the reaction, the organic phase was extracted with chloroform, washed with water, and dried over anhydrous sodium sulfate. The solvent was removed under vacuum and the residue was purified by silica gel chromatography. As a result, 3.2 parts of compound A216 was obtained.

Synthetic Example 7

By the same method as that in Synthetic Example 6, 7.4 parts of 2,7-dibromo-9,10-phenanthrolinequinone was synthesized in a nitrogen atmosphere from 2.8 parts of 3-aminophenylboronic acid monohydrate and phenanthrolinequinone (produced by Sigma-Aldrich Japan). To a mixed solvent containing 100 parts of toluene and 50 parts of ethanol, 7.4 parts of 2,7-dibromo-9,10-phenanthrolinequinone was added and 100 parts of a 20% aqueous sodium carbonate solution was added dropwise to the resulting mixture. Then 0.55 parts of tetrakis(triphenylphosphine)palladium(0) was added and refluxing was conducted for 2 hours. After completion of the reaction, the organic phase was extracted with chloroform, washed with water, and dried over anhydrous sodium sulfate. The solvent was removed under vacuum and the residue was purified by silica gel chromatography. As a result, 2.2 parts of compound A316 was obtained.

Synthetic Example 8

To 200 parts of dimethylacetamide, 7.4 parts of perylenetetracarboxylic dianhydride (produced by Tokyo Chemical Industry Co., Ltd.), 4 parts of 2,6-diethylaniline (produced by Tokyo Chemical Industry Co., Ltd.), and 4 parts of 2-aminophenylethanol were added in a nitrogen atmosphere. Stirring was conducted at room temperature for 1 hour to prepare a solution. The solution prepared was refluxed for 8 hours. Precipitates were filtered out and recrystallized with ethyl acetate. As a result, 5.0 parts of compound A803 was obtained.

Synthetic Example 9

To 200 parts of dimethylacetamide, 5.4 parts of naphthalenetetracarboxylic dianhydride, 2.6 parts of leucinol, and 2.7 parts of 2-(2-aminoethylthio)ethanol were added in a nitrogen atmosphere. The resulting mixture was stirred at room temperature for 1 hour and refluxed for 7 hours. Dimethylacetamide was removed from the resulting dark brown solution by vacuum distillation and the product was dissolved in an ethyl acetate/toluene mixed solution.

The resulting product was fractionized by silica gel column chromatography (eluent: ethyl acetate/toluene). The fraction containing the target substance was condensed and the resulting crystals were recrystallized in a toluene/hexane mixed solution. As a result, 2.5 parts of compound A173 (imide compound represented by formula (23) was obtained.

Synthetic Example 10

To 200 parts of dimethylacetamide, 5.4 parts of naphthalenetetracarboxylic dianhydride and 5.2 parts of leucinol were added in a nitrogen atmosphere. The resulting mixture was stirred at room temperature for 1 hour and refluxed for 7 hours. Dimethylacetamide was removed by vacuum distillation and the product was recrystallized with ethyl acetate. As a result, 5.0 parts of compound A157 (imide compound represented by formula (24)) was obtained.

Electrophotographic photosensitive members were produced as described below and evaluated.

Example 1

An aluminum cylinder (Japanese Industrial Standard (JIS) A3003, aluminum alloy) having a length of 260.5 mm and a diameter of 30 mm was used as a support (conductive support).

Into a sand mill containing glass beads 1 mm in diameter, 50 parts of titanium oxide particles (powder resistivity: 120 Ω·cm, coverage of tin oxide: 40%) coated with oxygen-deficient tin oxide, 40 parts of a phenolic resin (PLYOPHEN J-325, produced by DIC Corporation, resin solid content: 60%), and 40 parts of methoxypropanol were placed and the resulting mixture was dispersed for 3 hours to prepare a coating solution (dispersion) for a conductive layer. The coating solution was applied to the support by dip coating and the resulting coating film was dried and thermally cured at 145° C. for 30 minutes. As a result, a conductive layer having a thickness of 16 μm was obtained.

The average particle size of the titanium oxide particles coated with oxygen-deficient tin oxide in the coating solution for the conductive layer was measured with a particle size analyzer (trade name: CAPA700 produced by Horiba Ltd.) by using tetrahydrofuran as a dispersion medium through a centrifugal sedimentation technique at a speed of rotation of 5000 rpm. The average particle size observed was 0.33 μm.

In a mixed solvent containing 100 parts of dimethylacetamide and 100 parts of methyl ethyl ketone, 8 parts of compound A101, 10 parts of an isocyanate compound (I-1) blocked with a group represented by formula (1), 0.1 parts of zinc(II) octylate serving as a catalyst, and 2 parts of resin B1 were dissolved to prepare a coating solution for an undercoat layer. The coating solution for an undercoat layer was applied to the conductive layer by dip coating. The resulting coating film was heated at 160° C. for 30 minutes to be cured (polymerized). As a result, an undercoat layer having a thickness of 0.5 μm was obtained.

Into a sand mill containing glass beads 1 mm in diameter, 260 parts of cyclohexanone, 5 parts of a polyvinyl butyral resin (trade name: S-LEC BX-1 produced by Sekisui Chemical Co., Ltd.), and 10 parts of hydroxygallium phthalocyanine crystals (charge generating substance) that have intense peaks at Bragg's angles (2θ±0.2°) of 7.5°, 9.9°, 12.5°, 16.3°, 18.6°, 25.1°, and 28.3° in X-ray diffraction with CuKα radiation were placed and a dispersion treatment was carried out for 1.5 hours. To the resulting mixture, 240 parts of ethyl acetate was added to prepare a coating solution for a charge generating layer. The coating solution for a charge generating layer was applied to the undercoat layer by dip coating and the resulting coating film was dried at 95° C. for 10 minutes to form a charge generating layer having a thickness of 0.18 μm.

In a mixed solvent containing 30 parts of dimethoxymethane and 70 parts of chlorobenzene, 7 parts of an amine compound (hole transporting substance) represented by formula (15) below and 10 parts of a polyester resin D being constituted by a repeating structural unit represented by formula (16-1) below and a repeating structural unit represented by formula (16-2) below at a 5/5 ratio and having a weight-average molecular weight (Mw) of 100,000 were dissolved to prepare a coating solution for a charge transporting layer. The coating solution for a charge transporting layer was applied to the charge generating layer by dip coating and the resulting coating film was dried at 120° C. for 60 minutes. As a result, a charge transporting layer having a thickness of 15 μm was obtained.

(15)

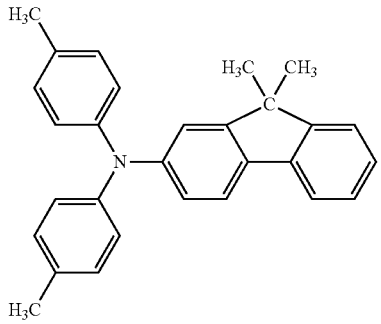

(16-1)

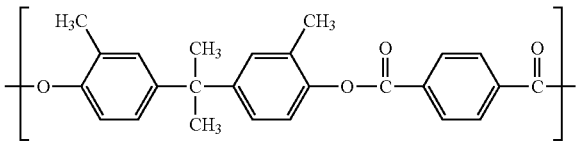

(16-2)

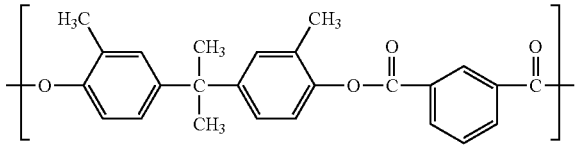

As a result, an electrophotographic photosensitive member that included a conductive layer, an undercoat layer, a charge generating layer, and a charge transporting layer that were stacked in that order on a support was obtained.

The electrophotographic photosensitive member obtained was loaded in a modified laser beam printer (trade name: LBP-2510 produced by Canon Kabushiki Kaisha) in a 15° C. 10% RH environment. The surface potential was measured and the output images were evaluated. The details are described below.

The surface potential was measured as follows. A cyan process cartridge of the laser beam printer described above was modified by attaching a potential probe (model 6000B-8 produced by TREK JAPAN KK) at a development position. The potential at the central part of the electrophotographic photosensitive member was measured with a surface potentiometer (model 1344 produced by TREK JAPAN KK). The dose of the image exposure was set so that the surface potential of the drum was −500 V in terms of an initial dark potential (Vd) and −100 V in terms of an initial light potential (Vl).

The electrophotographic photosensitive member prepared was loaded in the cyan process cartridge of the laser beam printer described above. The process cartridge was attached to the cyan process cartridge station and images were output. First, one sheet with a solid white image, five sheets with images for ghosting evaluation, one sheet with a solid black image, and five sheets with images for ghosting evaluation were continuously output in that order. Then full color images (characters with a printing ratio of 1% for each color) were output on 10,000 sheets of A4 size regular paper and then one sheet with a solid white image, five sheets with images for ghosting evaluation, one sheet with a solid black image, and five sheets with images for ghosting evaluation were continuously output in that order.

Figure 2:
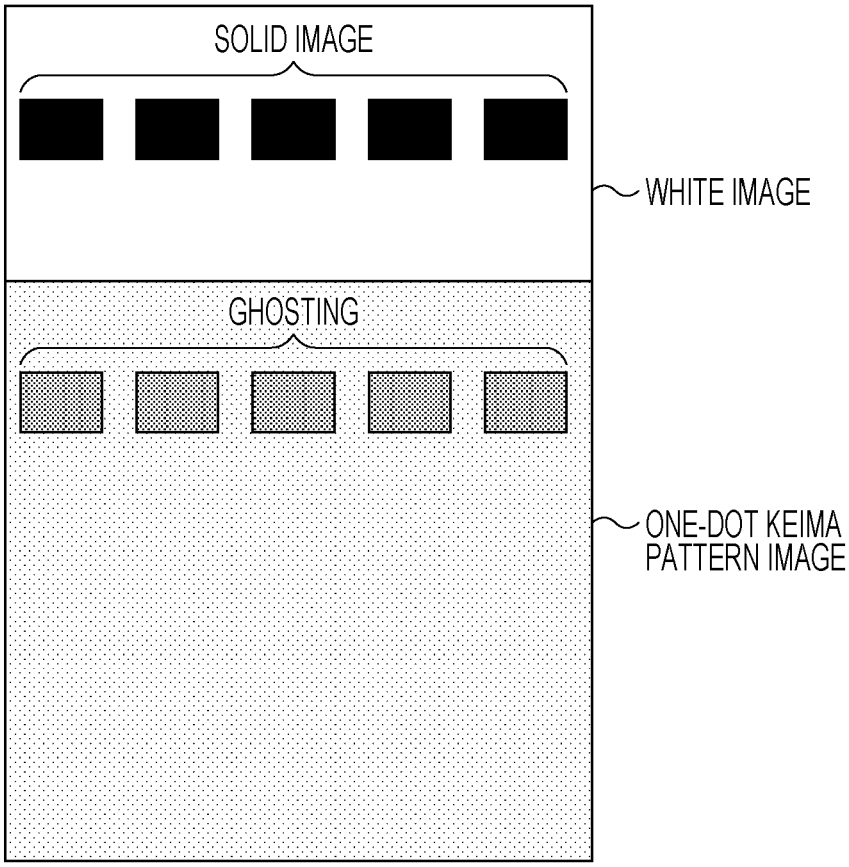
FIG. 2 is a diagram illustrating a print pattern used for evaluating ghost images.
Figure 3:
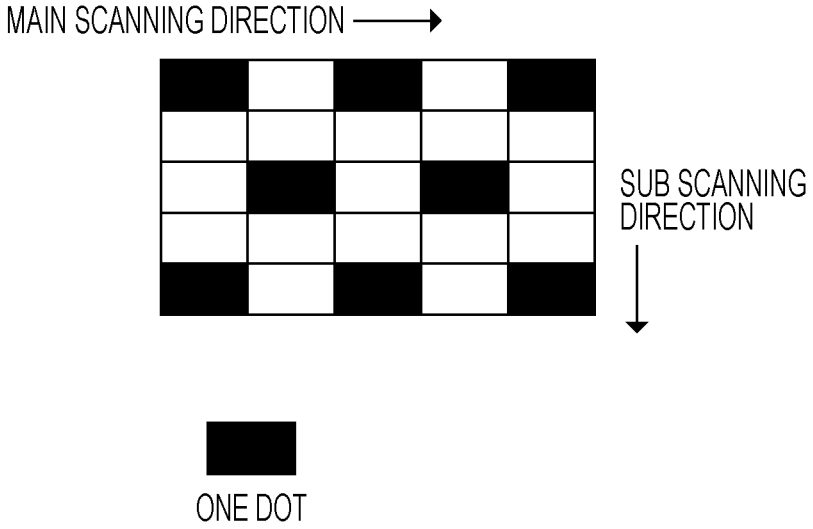
FIG. 3 is a diagram illustrating a one-dot Keima pattern.

FIG. 2 shows the image for ghosting evaluation. As shown in FIG. 2, the printout includes a white image portion in an upper portion where square solid images were printed and a one-dot Keima pattern portion in a lower portion where a half tone image of a variation of a checkerboard pattern constituted by checkerboard rows separated by white rows as shown in FIG. 3 (such a pattern is referred to as a one-dot Keima pattern herein) was printed. In FIG. 2, portions where ghosting derived from solid images can occur are marked as "ghosting".

The positive ghosting evaluation was carried out by measuring the difference between the image density of the half tone image of the one-dot Keima pattern and the image density at the ghosting portions. The density difference was measured at ten points in one sheet of the image for ghosting evaluation by using a spectro densitomer (trade name: X-Rite 504/508, produced by X-Rite Inc.). This operation was conducted on all of the ten sheets of the images for ghosting evaluation and the results of that total of one hundred points were averaged to find the Macbeth density difference (initial) at the time of initial image output. Next, after outputting 10,000 sheets of paper, the difference (change) between the Macbeth density difference after the output and the Macbeth density difference at the time of initial image output was determined and assumed to be the amount of change in Macbeth density difference. The smaller the change in Macbeth density difference, the more suppressed the positive ghosting. The smaller the difference between the Macbeth density difference after output of 10,000 sheets and the Macbeth density difference at the time of initial image output, the smaller the change induced by positive ghosting. The results are shown in Table 10.

Examples 2 to 122

An electrophotographic photosensitive member was produced as in Example 1 except that the types and contents of the isocyanate compound (compound I, blocking group $X^1$), the resin (resin B) having a repeating structural unit represented by formula (B), and the electron transporting substance (compound A) used in Example 1 were changed as shown in Tables 10 and 11. Evaluation of positive ghosting was conducted in the same manner. The results are shown in Tables 10 and 11.

Example 123

An electrophotographic photosensitive member was produced as in Example 112 except that the conductive layer in Example 112 was changed in the following manner. Evaluation of positive ghosting was conducted in the same manner. The results are shown in Tables 10 and 11.

Into a sand mill containing 450 parts of glass beads 0.8 mm in diameter, 207 parts of titanium oxide ($TiO_2$) coated with a phosphorus (P)-doped tin oxide ($SnO_2$) (serving as metal oxide particles), 144 parts of a phenolic resin (trade name: PLYOPHEN J-325, produced by DIC Corporation, resin solid content: 60 mass %) as the binder resin, and 98 parts of 1-methoxy-2-propanol as the solvent were placed and a dispersion treatment was carried out at a speed of rotation of 2000 rpm, a dispersion treatment time of 4.5 hours, and a cooling water setting temperature of 18° C. to obtain a dispersion. The dispersion was passed through a mesh (150 μm aperture) to remove the glass beads.

Silicone resin particles (trade name: Tospearl 120 produced by Momentive Performance Materials Inc., average particle diameter: 2 μm) serving as a surface roughness imparter were added to the dispersion after the removal of the glass beads so that the amount of the silicone resin particles was 15 mass % relative to the total mass of the binder resin and the metal oxide particles in the dispersion. A silicone oil (trade name: SH28PA produced by Dow Corning Toray Co., Ltd.) serving as a leveling agent was added to the dispersion so that the amount of the silicone oil was 0.01 mass % relative to the total mass of the metal oxide particles and the binder resin in the dispersion. The resulting mixture was stirred to prepare a coating solution for a conductive layer. The coating solution for a conductive layer was applied to the support by dip coating and the resulting coating film was dried and thermally cured at 150° C. for 30 minutes. As a result, a conductive layer having a thickness of 30 μm was obtained.

Example 124

An electrophotographic photosensitive member was produced as in Example 112 except that the conductive layer of Example 112 was changed as below. Evaluation of positive ghosting was conducted in the same manner. The results are shown in Tables 10 and 11.

Into a sand mill containing 450 parts of glass beads 0.8 mm in diameter, 214 parts of titanium oxide ($TiO_2$) coated with an oxygen deficient tin oxide ($SnO_2$) (serving as metal oxide particles), 132 parts of a phenolic resin (trade name: PLYOPHEN J-325) as the binder resin, and 98 parts of 1-methoxy-2-propanol as the solvent were placed and a dispersion treatment was carried out at a speed of rotation of 2000 rpm, a dispersion treatment time of 4.5 hours, and a cooling water setting temperature of 18° C. to obtain a dispersion. The dispersion was passed through a mesh (150 μm aperture) to remove the glass beads.

Silicone resin particles (trade name: Tospearl 120) serving as a surface roughness imparter was added to the dispersion after the removal of the glass beads so that the amount of the silicone resin particles was 10 mass % relative to the total mass of the binder resin and the metal oxide particles in the dispersion. A silicone oil (trade name: SH28PA) serving as a leveling agent was added to the dispersion so that the amount of the silicone oil was 0.01 mass % relative to the total mass of the metal oxide particles and the binder resin in the dispersion. The resulting mixture was stirred to prepare a coating solution for a conductive layer. The coating solution for a conductive layer was applied to the support by dip coating and the resulting coating film was dried and thermally cured at 150° C. for 30 minutes. As a result, a conductive layer having a thickness of 30 μm was obtained.

Example 125

Preparation of the coating solution for a charge transporting layer in Example 112 was altered as follows. A coating solution for a charge transporting layer was prepared by dissolving, in a mixed solvent containing 30 parts of dimethoxymethane and 50 parts of ortho-xylene, 9 parts of a charge transport substance having a structure represented by formula (8) above, 1 part of charge transport substance having a structure represented by formula (18) below, 3 parts of a polyester resin E (weight-average molecular weight: 90,000) containing a repeating structural unit represented by formula (26) below and a repeating structural unit represented by formula (25) below at a ratio of 7:3 in addition to a repeating structural unit represented by formula (24) below, and 7 parts of a polyester resin D. In the polyester resin E, the content of the repeating structural unit represented by formula (24) below was 10 mass % and the total content of the repeating structural units represented by formulae (25) and (26) was 90 mass %.

(18)

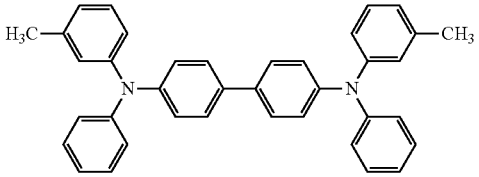

(24)

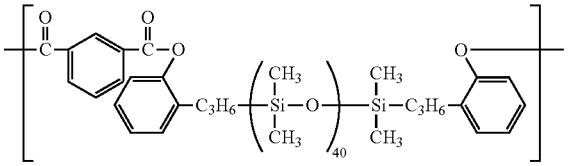

(25)

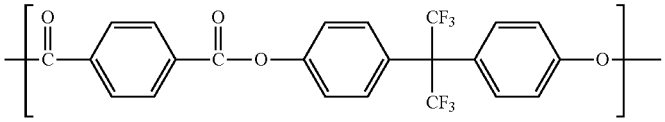

(26)

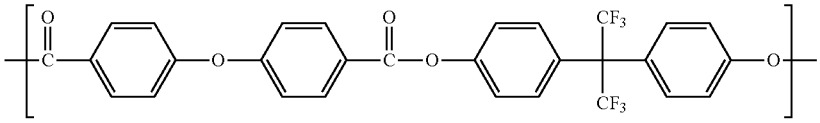

The coating solution for a charge transporting layer was applied to a charge generating layer by dip coating and dried at 120° C. for 60 minutes to form a charge transporting layer having a thickness of 15 μm. The charge transporting layer formed was confirmed to contain a domain structure containing the polyester resin E in the matrix containing the charge transport substance and the polyester resin D.

Example 126

Preparation of the coating solution for a charge transporting layer of Example 112 was altered as follows.

A coating solution for a charge transporting layer was prepared by dissolving, in a mixed solvent containing 30 parts of dimethoxymethane and 50 parts of ortho-xylene, 9 parts of a charge transport substance having a structure represented by formula (8) above, 1 part of a charge transport substance having a structure represented by formula (18) above, 10 parts of a polycarbonate resin F (weight-average molecular weight: 70,000) having a repeating structural unit represented by formula (29) below, and 0.3 parts of a polycarbonate resin G (weight-average molecular weight: 40,000) having a repeating structural unit represented by formula (29) below and a repeating structural unit represented by formula (30) below, and a structure represented by formula (31) in at least one terminus. In the polycarbonate resin G, the total mass of the structures represented by formulae (30) and (31) below was 30 mass %. The coating solution for a charge transporting layer was applied to the charge generating layer by dip coating and dried at 120° C. for 60 minutes. As a result, a charge transporting layer having a thickness of 15 μm was obtained.

(29)

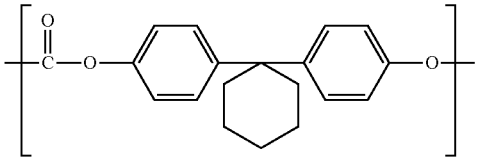

-continued (30)

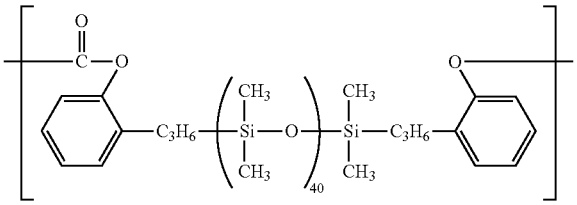

(31)

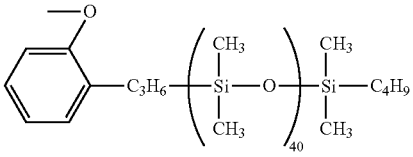

Example 127

A coating solution for a charge transporting layer was prepared and an electrophotographic photosensitive member was produced as in Example 126 except that 10 parts of the polyester resin D was used instead of 10 parts of the polycarbonate resin F in preparation of the coating solution for a charge transporting layer.

TABLE 10

| Example | Compound A | Parts by mass | Molecular weight | Isocyanate compound I | Blocking group $X^1$ | Parts by mass | Molecular weight | Resin B | Parts by mass | Compound A/crosslinking agent | Macbeth density (change) | Macbeth density (initial) |
|---|---|---|---|---|---|---|---|---|---|---|---|---|
| 1 | A101 | 4 | 456.49 | I-1 | (1) | 6.9 | 504 | B1 | 1.4 | 0.91 | 0.002 | 0.024 |
| 2 | A101 | 4 | 456.49 | I-1 | None | 4.5 | 504 | B1 | 1.5 | 0.91 | 0.002 | 0.025 |
| 3 | A101 | 4 | 456.49 | I-1 | (2) | 7.3 | 504 | B1 | 1.5 | 0.91 | 0.002 | 0.025 |
| 4 | A101 | 4 | 456.49 | I-1 | (3) | 7.6 | 504 | B1 | 1.4 | 0.91 | 0.002 | 0.025 |
| 5 | A101 | 4 | 456.49 | I-1 | (4) | 6.4 | 504 | B1 | 1.4 | 0.91 | 0.002 | 0.025 |
| 6 | A101 | 4 | 456.49 | I-1 | (5) | 7.2 | 504 | B1 | 1.4 | 0.91 | 0.002 | 0.025 |
| 7 | A101 | 4 | 456.49 | I-1 | (6) | 8.1 | 504 | B1 | 1.4 | 0.91 | 0.002 | 0.025 |
| 8 | A101 | 4 | 456.49 | I-1 | (1) | 6.9 | 504 | B2 | 1.4 | 0.91 | 0.002 | 0.025 |
| 9 | A101 | 4 | 456.49 | I-1 | (1) | 6.9 | 504 | B3 | 1.4 | 0.91 | 0.002 | 0.025 |
| 10 | A101 | 4 | 456.49 | I-1 | (1) | 5.6 | 504 | B4 | 2.3 | 0.91 | 0.002 | 0.027 |
| 11 | A101 | 4 | 456.49 | I-1 | (1) | 6.8 | 504 | B5 | 1.5 | 0.91 | 0.002 | 0.025 |
| 12 | A101 | 4 | 456.49 | I-1 | (1) | 6.6 | 504 | B6 | 1.6 | 0.91 | 0.002 | 0.025 |
| 13 | A101 | 4 | 456.49 | I-1 | (1) | 6.7 | 504 | B7 | 1.6 | 0.91 | 0.002 | 0.025 |
| 14 | A101 | 4 | 456.49 | I-1 | (1) | 6.7 | 504 | B11 | 1.6 | 0.91 | 0.002 | 0.027 |
| 15 | A101 | 4 | 456.49 | I-1 | (1) | 7.6 | 504 | B1 | 1 | 0.91 | 0.002 | 0.025 |
| 16 | A101 | 4 | 456.49 | I-1 | (1) | 4.7 | 504 | B1 | 2.9 | 0.91 | 0.003 | 0.025 |
| 17 | A101 | 4 | 456.49 | I-1 | (1) | 2.8 | 504 | B1 | 4 | 0.91 | 0.003 | 0.026 |
| 18 | A103 | 4 | 490.51 | I-1 | (1) | 6.7 | 504 | B1 | 1.5 | 0.97 | 0.002 | 0.025 |
| 19 | A112 | 4 | 518.52 | I-1 | (1) | 6.7 | 504 | B8 | 1.6 | 1.03 | 0.002 | 0.027 |
| 20 | A113 | 4 | 489.52 | I-1 | (1) | 5.6 | 504 | B9 | 2.3 | 0.97 | 0.003 | 0.027 |
| 21 | A114 | 4 | 506.57 | I-1 | (1) | 5.5 | 504 | B10 | 2.3 | 1.01 | 0.002 | 0.027 |
| 22 | A119 | 4 | 506.51 | I-1 | (1) | 6.7 | 504 | B1 | 1.6 | 1.00 | 0.002 | 0.025 |
| 23 | A123 | 4 | 500.41 | I-1 | (1) | 8.6 | 504 | B1 | 0.3 | 0.99 | 0.002 | 0.025 |
| 24 | A124 | 4 | 478.45 | I-1 | (1) | 8.8 | 504 | B1 | 0.2 | 0.95 | 0.002 | 0.025 |
| 25 | A128 | 4 | 534.47 | I-1 | (1) | 8.4 | 504 | B2 | 0.4 | 1.06 | 0.002 | 0.024 |
| 26 | A131 | 4 | 527.58 | I-1 | (1) | 6.6 | 504 | B2 | 1.7 | 1.05 | 0.002 | 0.024 |
| 27 | A134 | 4 | 506.51 | I-1 | (1) | 8.6 | 504 | B2 | 0.3 | 1.00 | 0.002 | 0.025 |
| 28 | A135 | 4 | 534.56 | I-1 | (1) | 8.4 | 504 | B2 | 0.4 | 1.06 | 0.002 | 0.024 |
| 29 | A101 | 4 | 456.49 | I-4 | (1) | 6.9 | 522 | B2 | 1.4 | 0.87 | 0.002 | 0.025 |
| 30 | A142 | 4 | 582.6 | I-15 | (1) | 6.6 | 601 | B2 | 1.4 | 0.97 | 0.002 | 0.025 |
| 31 | A142 | 4 | 582.6 | I-12 | (1) | 6.7 | 667 | B2 | 1.2 | 0.87 | 0.002 | 0.026 |
| 32 | A142 | 4 | 582.6 | I-7 | (1) | 6.6 | 640 | B2 | 1.3 | 0.91 | 0.002 | 0.026 |
| 33 | A142 | 4 | 582.6 | I-5 | (1) | 6.6 | 643 | B2 | 1.3 | 0.91 | 0.002 | 0.025 |
| 34 | A803 | 4 | 642.7 | I-12 | (1) | 6.5 | 667 | B1 | 1.3 | 0.96 | 0.002 | 0.027 |
| 35 | A805 | 4 | 628.67 | I-12 | (1) | 6.5 | 667 | B1 | 1.3 | 0.94 | 0.002 | 0.027 |
| 36 | A812 | 4 | 642.65 | I-12 | (1) | 6.5 | 667 | B1 | 1.3 | 0.96 | 0.002 | 0.028 |
| 37 | A813 | 4 | 613.66 | I-12 | (1) | 6.5 | 667 | B1 | 1.3 | 0.92 | 0.003 | 0.027 |
| 38 | A814 | 4 | 630.71 | I-12 | (1) | 6.5 | 667 | B1 | 1.3 | 0.95 | 0.002 | 0.028 |
| 39 | A819 | 4 | 630.65 | I-12 | (1) | 6.5 | 667 | B1 | 1.3 | 0.95 | 0.002 | 0.028 |
| 40 | A825 | 4 | 642.7 | I-12 | (1) | 8.1 | 667 | B1 | 0.2 | 0.96 | 0.002 | 0.028 |
| 41 | A826 | 4 | 630.66 | I-12 | (1) | 8.1 | 667 | B1 | 0.2 | 0.95 | 0.003 | 0.028 |
| 42 | A803 | 4 | 642.7 | I-5 | (1) | 6.5 | 643 | B1 | 1.3 | 1.00 | 0.002 | 0.027 |

TABLE 10-continued

| Example | Compound A | Parts by mass | Molecular weight | Isocyanate compound I | Blocking group $X^1$ | Parts by mass | Molecular weight | Resin B | Parts by mass | Compound A/crosslinking agent | Macbeth density (change) | Macbeth density (initial) |
|---|---|---|---|---|---|---|---|---|---|---|---|---|
| 43 | A803 | 4 | 642.7 | I-7 | (1) | 6.5 | 640 | B1 | 1.3 | 1.00 | 0.002 | 0.027 |
| 44 | A514 | 4 | 434.36 | I-1 | (1) | 7 | 504 | B1 | 1.4 | 0.86 | 0.002 | 0.035 |
| 45 | A514 | 4 | 434.36 | I-1 | (5) | 7.2 | 504 | B1 | 1.4 | 0.86 | 0.002 | 0.032 |
| 46 | A514 | 4 | 434.36 | I-1 | (1) | 6.8 | 504 | B18 | 1.5 | 0.86 | 0.002 | 0.036 |
| 47 | A531 | 4 | 334.37 | I-2 | (1) | 6.1 | 294 | B1 | 2.7 | 1.14 | 0.002 | 0.035 |
| 48 | A725 | 4 | 508.65 | I-1 | (1) | 8.6 | 504 | B1 | 0.3 | 1.01 | 0.002 | 0.035 |
| 49 | A726 | 4 | 548.63 | I-1 | (1) | 8.3 | 504 | B1 | 0.5 | 1.09 | 0.002 | 0.037 |
| 50 | A727 | 4 | 536.61 | I-1 | (1) | 8.4 | 504 | B1 | 0.4 | 1.06 | 0.002 | 0.033 |
| 51 | A728 | 4 | 478.62 | I-1 | (1) | 8.8 | 504 | B1 | 0.2 | 0.95 | 0.003 | 0.034 |
| 52 | A729 | 4 | 512.73 | I-1 | (1) | 8.5 | 504 | B1 | 0.3 | 1.02 | 0.003 | 0.035 |
| 53 | A725 | 4 | 548.63 | I-4 | (1) | 8.3 | 522 | B1 | 0.4 | 1.05 | 0.002 | 0.035 |
| 54 | A726 | 4 | 548.63 | I-15 | (1) | 8.5 | 601 | B1 | 0.1 | 0.91 | 0.002 | 0.036 |
| 55 | A601 | 4 | 264 | I-2 | (1) | 7.8 | 294 | B1 | 1.8 | 0.90 | 0.002 | 0.035 |

TABLE 11

| Example | Compound A | Parts by mass | Molecular weight | Isocyanate compound I | Blocking group $X^1$ | Parts by mass | Molecular weight | Resin B | Parts by mass | Compound A/crosslinking agent | Macbeth density (change) | Macbeth density (initial) |
|---|---|---|---|---|---|---|---|---|---|---|---|---|
| 56 | A601 | 4 | 264 | I-2 | (1) | 7.5 | 294 | B5 | 2 | 0.90 | 0.002 | 0.032 |
| 57 | A601 | 4 | 264 | I-2 | (1) | 7.2 | 294 | B6 | 2.1 | 0.90 | 0.002 | 0.037 |
| 58 | A603 | 4 | 278 | I-2 | (1) | 7.7 | 294 | B1 | 1.9 | 0.95 | 0.002 | 0.037 |
| 59 | A603 | 4 | 278 | I-2 | (1) | 7 | 294 | B14 | 2.3 | 0.95 | 0.003 | 0.035 |
| 60 | A603 | 4 | 278 | I-2 | (1) | 7.1 | 294 | B17 | 2.2 | 0.95 | 0.003 | 0.035 |
| 61 | A701 | 4 | 290.3 | I-2 | (1) | 7.5 | 294 | B3 | 2 | 0.99 | 0.002 | 0.036 |
| 62 | A216 | 4 | 420 | I-1 | (1) | 8.9 | 504 | B1 | 0.1 | 0.83 | 0.002 | 0.045 |
| 63 | A217 | 4 | 448 | I-1 | (1) | 8.6 | 504 | B1 | 0.3 | 0.89 | 0.002 | 0.045 |
| 64 | A219 | 4 | 424.53 | I-1 | (1) | 8.9 | 504 | B1 | 0.1 | 0.84 | 0.002 | 0.042 |
| 65 | A225 | 4 | 472.58 | I-1 | (1) | 8.4 | 504 | B1 | 0.4 | 0.94 | 0.002 | 0.048 |
| 66 | A226 | 4 | 438.48 | I-1 | (1) | 8.7 | 504 | B1 | 0.2 | 0.87 | 0.002 | 0.042 |
| 67 | A227 | 4 | 496.47 | I-1 | (1) | 8.2 | 504 | B1 | 0.5 | 0.99 | 0.003 | 0.044 |
| 68 | A228 | 4 | 468.5 | I-1 | (1) | 8.4 | 504 | B1 | 0.4 | 0.93 | 0.003 | 0.045 |
| 69 | A314 | 4 | 422 | I-1 | (1) | 8.9 | 504 | B1 | 0.1 | 0.84 | 0.002 | 0.043 |
| 70 | A315 | 4 | 450 | I-1 | (1) | 8.6 | 504 | B1 | 0.3 | 0.89 | 0.002 | 0.046 |
| 71 | A316 | 4 | 392 | I-1 | (1) | 8.9 | 504 | B1 | 0.1 | 0.78 | 0.002 | 0.048 |
| 72 | A317 | 4 | 426.53 | I-1 | (1) | 8.4 | 504 | B1 | 0.4 | 0.85 | 0.002 | 0.043 |
| 73 | A412 | 4 | 453.53 | I-1 | (1) | 6.6 | 504 | B1 | 1.7 | 0.90 | 0.002 | 0.043 |
| 74 | A412 | 4 | 453.53 | I-4 | (1) | 6.6 | 522 | B1 | 1.6 | 0.87 | 0.002 | 0.046 |
| 75 | A415 | 4 | 442 | I-1 | (1) | 8.7 | 504 | B1 | 0.2 | 0.88 | 0.002 | 0.042 |
| 76 | A416 | 4 | 470.43 | I-1 | (1) | 8.4 | 504 | B1 | 0.4 | 0.93 | 0.002 | 0.045 |
| 77 | A418 | 4 | 446.54 | I-1 | (1) | 8.6 | 504 | B1 | 0.3 | 0.89 | 0.003 | 0.046 |
| 78 | A431 | 4 | 536.61 | I-1 | (1) | 6.6 | 504 | B1 | 2.6 | 1.06 | 0.002 | 0.042 |
| 79 | A101 | 4 | 456.49 | I-5 | (1) | 7.3 | 642 | B1 | 0.8 | 0.71 | 0.004 | 0.026 |
| 80 | A110 | 4 | 422.47 | I-5 | (1) | 7.3 | 642 | B1 | 0.8 | 0.66 | 0.004 | 0.024 |
| 81 | A101 | 4 | 456.49 | I-7 | (1) | 7.3 | 640 | B1 | 0.8 | 0.71 | 0.004 | 0.025 |
| 82 | A101 | 4 | 456.49 | I-12 | (1) | 7.2 | 667 | B1 | 0.8 | 0.68 | 0.004 | 0.024 |
| 83 | A113 | 4 | 489.52 | I-12 | (1) | 7 | 667 | B1 | 0.9 | 0.73 | 0.004 | 0.026 |
| 84 | A803 | 4 | 642.7 | I-11 | (1) | 6.8 | 907 | B1 | 0.7 | 0.71 | 0.004 | 0.027 |
| 85 | A803 | 4 | 642.7 | I-1 | (1) | 6.3 | 505 | B1 | 1.8 | 1.27 | 0.004 | 0.026 |
| 86 | A514 | 4 | 434.36 | I-5 | (1) | 7.2 | 642 | B1 | 0.8 | 0.68 | 0.004 | 0.037 |
| 87 | A514 | 4 | 434.36 | I-7 | (1) | 7 2 | 639 | B1 | 0.8 | 0.68 | 0.004 | 0.035 |
| 88 | A522 | 4 | 410.47 | I-2 | (1) | 8.8 | 294 | B1 | 1.3 | 1.40 | 0.005 | 0.034 |
| 89 | A532 | 4 | 451.4 | I-7 | (1) | 7.1 | 640 | B1 | 0.9 | 0.71 | 0.004 | 0.035 |
| 90 | A725 | 4 | 478.62 | I-11 | (1) | 7.2 | 787 | B1 | 0.6 | 0.61 | 0.004 | 0.036 |
| 91 | A414 | 4 | 301.34 | I-1 | (1) | 8 | 504 | B1 | 0.7 | 0.60 | 0.004 | 0.046 |
| 92 | A430 | 4 | 350 | I-1 | (1) | 7.5 | 504 | B1 | 1 | 0.69 | 0.004 | 0.044 |
| 93 | A232 | 4 | 417.37 | I-15 | (1) | 7.3 | 601 | B1 | 0.9 | 0.69 | 0.004 | 0.045 |
| 94 | A101 | 4 | 456.49 | I-2 | (1) | 6.4 | 294 | B1 | 2.6 | 1.55 | 0.008 | 0.026 |
| 95 | A101 | 4 | 456.49 | I-10 | (1) | 7.4 | 907 | B1 | 0.2 | 0.50 | 0.009 | 0.028 |
| 96 | A831 | 4 | 830.87 | I-1 | (1) | 5.9 | 504 | B1 | 2.1 | 1.65 | 0.008 | 0.027 |
| 97 | A514 | 4 | 434.36 | I-10 | (1) | 7.5 | 907 | B1 | 0.1 | 0.48 | 0.009 | 0.037 |
| 98 | A515 | 4 | 440.49 | I-2 | (1) | 8.5 | 294 | B1 | 1.5 | 1.50 | 0.009 | 0.036 |
| 99 | A601 | 4 | 264.28 | I-1 | (1) | 8.4 | 504 | B1 | 0.5 | 0.52 | 0.008 | 0.038 |
| 100 | A412 | 4 | 453.53 | I-10 | (1) | 7.4 | 907 | B1 | 0.2 | 0.50 | 0.009 | 0.048 |
| 101 | A414 | 4 | 301.34 | I-12 | (1) | 7.9 | 667 | B1 | 0.3 | 0.45 | 0.009 | 0.045 |
| 102 | A232 | 4 | 417 | I-3 | (1) | 6.2 | 201 | B1 | 3.2 | 2.07 | 0.011 | 0.043 |
| 103 | A406 | 4 | 301 | I-13 | (1) | 7.5 | 790 | B1 | 0.3 | 0.38 | 0.011 | 0.045 |
| 104 | A412 | 4 | 453 | I-3 | (1) | 6 | 201 | B1 | 3.3 | 2.25 | 0.011 | 0.046 |
| 105 | A431 | 4 | 563 | I-16 | (1) | 5.9 | 267 | B1 | 3 | 2.11 | 0.011 | 0.044 |
| 106 | A602 | 4 | 264.28 | I-21 | (1) | 7 | 1250 | B1 | 0.1 | 0.21 | 0.013 | 0.035 |
| 107 | A412 | 4 | 453.53 | I-21 | (1) | 5.8 | 1250 | B1 | 1.2 | 0.36 | 0.015 | 0.045 |
| 108 | A521 | 4 | 272.26 | I-21 | (1) | 7 | 1250 | B1 | 0.2 | 0.22 | 0.02 | 0.045 |

TABLE 11-continued

| Example | Compound A | Parts by mass | Molecular weight | Isocyanate compound I | Blocking group $X^1$ | Parts by mass | Molecular weight | Resin B | Parts by mass | Compound A/crosslinking agent | Macbeth density (change) | Macbeth density (initial) |
|---|---|---|---|---|---|---|---|---|---|---|---|---|
| 109 | A610 | 4 | 198.18 | I-21 | (1) | 5 | 1250 | B1 | 1.1 | 0.16 | 0.023 | 0.045 |
| 110 | A222 | 4 | 252.22 | I-21 | (1) | 6.6 | 1250 | B1 | 0.5 | 0.20 | 0.024 | 0.045 |
| 111 | A421 | 4 | 274.27 | I-21 | (1) | 7 | 1250 | B1 | 0.2 | 0.22 | 0.021 | 0.045 |

TABLE 12

| Example | Compound A | Parts by mass | Molecular weight | Isocyanate compound I | Blocking group $X^1$ | Parts by mass | Molecular weight | Resin B | Parts by mass | Compound A/crosslinking agent | Macbeth density (change) | Macbeth density (initial) |
|---|---|---|---|---|---|---|---|---|---|---|---|---|
| 112 | A153 | 4 | 466.53 | I1 | (5) | 7.6 | 504 | B23 | 0.2 | 0.93 | 0.002 | 0.022 |
| 113 | A154 | 4 | 466.53 | I1 | (5) | 7.6 | 504 | B23 | 0.2 | 0.93 | 0.002 | 0.022 |
| 114 | A155 | 4 | 438.47 | I1 | (5) | 7.8 | 504 | B23 | 0.1 | 0.87 | 0.002 | 0.023 |
| 115 | A157 | 4 | 484.54 | I1 | (5) | 5.5 | 504 | B23 | 1.8 | 0.96 | 0.002 | 0.024 |
| 116 | A159 | 4 | 468.57 | I1 | (5) | 5.6 | 504 | B23 | 1.8 | 0.93 | 0.002 | 0.024 |
| 117 | A160 | 4 | 502.6 | I1 | (5) | 7.3 | 504 | B23 | 0.4 | 1.00 | 0.002 | 0.023 |
| 118 | A162 | 4 | 438.47 | I1 | (5) | 5.7 | 504 | B23 | 1.7 | 0.87 | 0.002 | 0.024 |
| 119 | A168 | 4 | 438.47 | I1 | (5) | 7.7 | 504 | B23 | 0.1 | 0.87 | 0.002 | 0.022 |
| 120 | A170 | 4 | 467.51 | I1 | (5) | 7.6 | 504 | B23 | 0.2 | 0.93 | 0.003 | 0.023 |
| 121 | A173 | 4 | 470.54 | I1 | (5) | 7.6 | 504 | B23 | 0.2 | 0.93 | 0.002 | 0.022 |
| 122 | A174 | 4 | 484.56 | I1 | (5) | 7.5 | 504 | B23 | 0.3 | 0.96 | 0.002 | 0.023 |
| 123 | A153 | 4 | 466.53 | I1 | (5) | 7.6 | 504 | B23 | 0.2 | 0.93 | 0.002 | 0.022 |
| 124 | A153 | 4 | 466.53 | I1 | (5) | 7.6 | 504 | B23 | 0.2 | 0.93 | 0.002 | 0.022 |
| 125 | A153 | 4 | 466.53 | I1 | (5) | 7.6 | 504 | B23 | 0.2 | 0.93 | 0.002 | 0.024 |
| 126 | A153 | 4 | 466.53 | I1 | (5) | 7.6 | 504 | B23 | 0.2 | 0.93 | 0.003 | 0.025 |
| 127 | A153 | 4 | 466.53 | I1 | (5) | 7.6 | 504 | B23 | 0.2 | 0.93 | 0.003 | 0.025 |

In Tables 10 to 12, "Compound A/crosslinking agent" refers to a ratio of the molecular weight of the compound A (electron transport material) to the molecular weight of the isocyanate compound (molecular weight calculated by excluding the blocking group $X^1$).

Comparative Example 1

An electrophotographic photosensitive member was produced as in Example 1 except that the isocyanate compound was changed to an isocyanate compound having a unit represented by formula (C-1) below (a copolymer described in Japanese Patent Laid-Open No. 2008-250082 (a copolymer of styrene and a unit represented by formula (C-1) below accounting for 5 mol % of the copolymer, weight-average molecular weight Mw: 42,000). Evaluation of ghosting was conducted as in Example 1. The difference in Macbeth density at the time of initial image output was 0.035 and the difference (change) in Macbeth density difference between after output of 10,000 sheets and at the time of initial image output was 0.042.

(C-1)

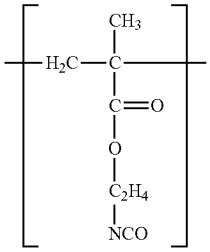

Comparative Example 2

An electrophotographic photosensitive member was produced as in Example 1 except that the undercoat layer was formed by using hexamethylene diisocyanate and the compound represented by formula (11) below (configuration of Example 1 of Japanese Patent Laid-Open No. 2007-148293). Evaluation of ghosting was conducted in the same manner as in Example 1. The difference in Macbeth density at the time of initial image output was 0.034 and the difference (change) in Macbeth density difference between after output of 10,000 sheets and at the time of initial image output was 0.051.

(11)

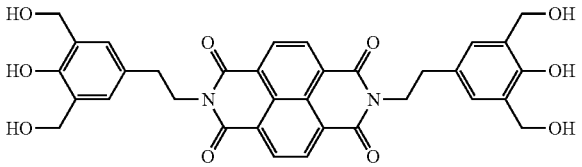

Comparative Example 3

An electrophotographic photosensitive member was produced as in Example 1 except that the undercoat layer was formed by using a blocked isocyanate compound, a butyral resin, and a compound represented by formula (12) below (configuration of Example 2 of Japanese Patent Laid-Open No. 2008-65173). Evaluation of ghosting was conducted in the same manner as in Example 1. The difference in Macbeth density at the time of initial image output was 0.052 and the difference (change) in Macbeth density difference between after output of 10,000 sheets and at the time of initial image output was 0.055.

(12)

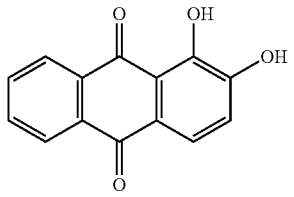

Comparative Example 4

An electrophotographic photosensitive member was produced as in Example 1 except that a block copolymer represented by structural formula below (copolymer described in PCT Japanese Translation Patent Publication No. 2009-505156) instead of Example compound A101. Evaluation was conducted in the same manner as in Example 1. The difference in Macbeth density at the time of initial image output was 0.040 and the difference (change) in Macbeth density difference between after output of 10,000 sheets and at the time of initial image output was 0.055.

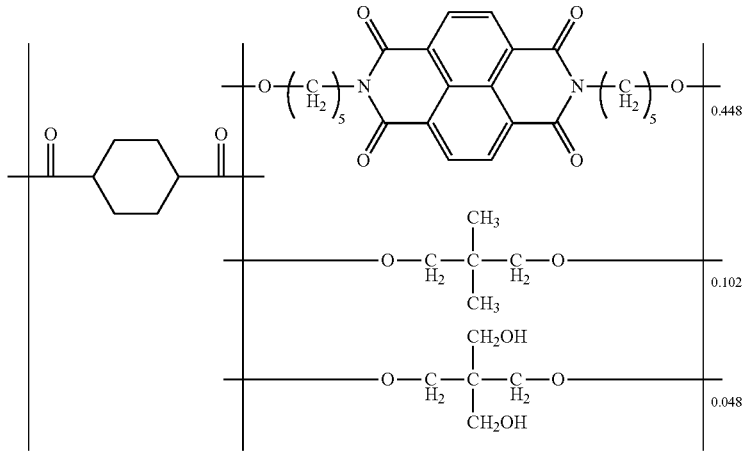

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-147156 filed Jun. 29, 2012, No. 2013-093091 filed Apr. 25, 2013, and No. 2013-112111 filed May 28, 2013, which are hereby incorporated by reference herein in their entirety.

What is claimed is:

1. An electrophotographic photosensitive member, comprising:

a support;

an undercoat layer formed on the support; and a photosensitive layer formed on the undercoat layer, wherein the undercoat layer comprises a polymerized product of a composition comprising (i) an isocyanate compound which has three to six groups selected from the group consisting of —NCO group and —NHCOX$^1$ group and has a molecular weight of 200 to 1300, the molecular weight being calculated without taking X$^1$ into account when the isocyanate compound has the —NHCOX$^1$ group, X$^1$ being a group represented by any one of formulae (1) to (7) below (1)

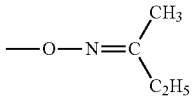

(2)

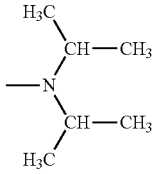

-continued (3)

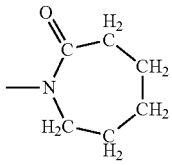

(4)

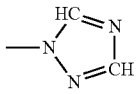

-continued (5)

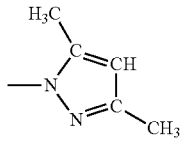

(6)

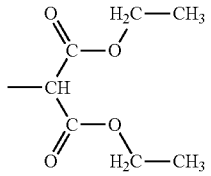

(7)

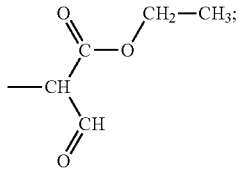

(ii) a resin having a repeating structural unit represented by formula (B) below (B)

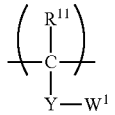

where $R^{11}$ represents a hydrogen atom or an alkyl group, Y represents a single bond or a phenylene group, and $W^1$ represents a hydroxy group, a thiol group, an amino group, or a carboxyl group; and (iii) at least one electron transporting substance selected from the group consisting of a compound represented by formula (A1) below, a compound represented by formula (A2) below, a compound represented by formula (A3) below, a compound represented by formula (A4) below, a compound represented by formula (A5) below, a compound represented by formula (A6) below, a compound represented by formula (A7) below, and a compound represented by formula (A8) below (A1)

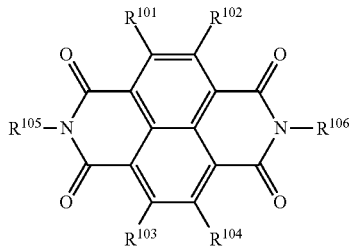

-continued (A2)

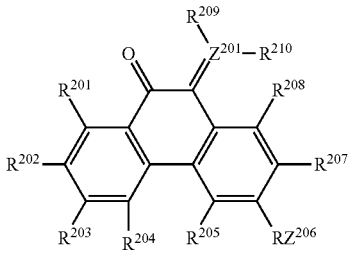

(A3)

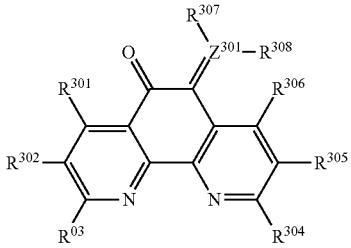

(A4)

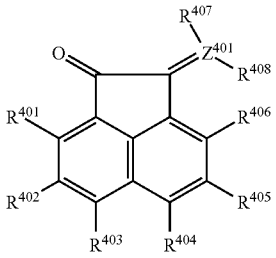

(A5)

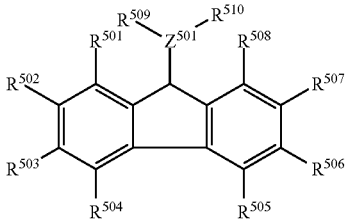

(A6)

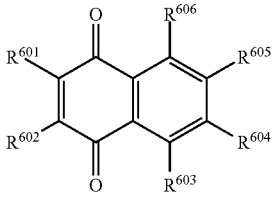

(A7)

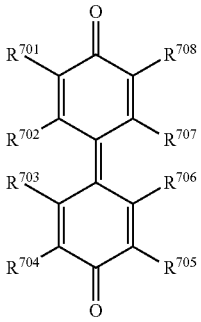

-continued (A8)

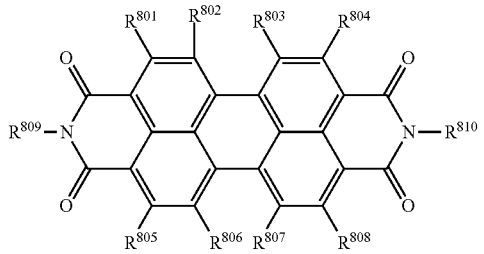

where $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, and $R^{801}$ to $R^{810}$ each independently represents a monovalent group represented by formula (A) below, a hydrogen atom, a cyano group, a nitro group, a halogen atom, an alkoxycarbonyl group, a substituted or unsubstituted alkyl group, a substituted or unsubstituted aryl group, or a substituted or unsubstituted heterocyclic group, at least one of the $R^{101}$ to $R^{106}$, at least one of the $R^{201}$ to $R^{210}$, at least one of the $R^{301}$ to $R^{308}$, at least one of the $R^{401}$ to $R^{408}$, at least one of the $R^{501}$ to $R^{510}$, at least one of the $R^{601}$ to $R^{606}$, at least one of the $R^{701}$ to $R^{708}$, and at least one of the $R^{801}$ to $R^{810}$ are each the monovalent group represented by formula (A) below, one of the carbon atoms in the alkyl group may be replaced with O, S, NH, or $NR^{901}$, $R^{901}$ representing an alkyl group, a substituent of the substituted alkyl group is a group selected from the group consisting of an alkyl group, an aryl group, an alkoxycarbonyl group, and a halogen atom, a substituent of the substituted aryl group is a group selected from the group consisting of a halogen atom, a nitro group, a cyano group, an alkyl group, and a halogen-substituted alkyl group, $Z^{201}$, $Z^{301}$, $Z^{401}$, and $Z^{501}$ each independently represents a carbon atom, a nitrogen atom, or an oxygen atom, $R^{209}$ and $R^{210}$ are absent when $Z^{201}$ is the oxygen atom, $R^{210}$ is absent when $Z^{201}$ is the nitrogen atom, $R^{307}$ and $R^{308}$ are absent when $Z^{301}$ is the oxygen atom, $R^{308}$ is absent when $Z^{301}$ is the nitrogen atom, $R^{407}$ and $R^{408}$ are absent when $Z^{401}$ is the oxygen atom, $R^{408}$ is absent when $Z^{401}$ is the nitrogen atom, $R^{509}$ and $R^{510}$ are absent when $Z^{501}$ is the oxygen atom, and $R^{510}$ is absent when $Z^{501}$ is the nitrogen atom, $$-(\alpha)_l-(\beta)_m\gamma \quad (A)$$

where at least one of α, β, and γ is a group having a substituent, the substituent being at least one group selected from the group consisting of a hydroxy group, a thiol group, an amino group, and a carboxyl group, l and m each independently represents 0 or 1, the sum of l and m is 0 to 2, α represents an alkylene group having 1 to 6 main-chain atoms, an alkylene group having 1 to 6 main-chain atoms and substituted with an alkyl group having 1 to 6 carbon atoms, an alkylene group having 1 to 6 main-chain atoms and substituted with a benzyl group, an alkylene group having 1 to 6 main-chain atoms and substituted with a alkoxycarbonyl group, or an alkylene group having 1 to 6 main-chain atoms and substituted with a phenyl group and may have at least one substituent selected from the group consisting of a hydroxy group, a thiol group, an amino group, and a carboxyl group, one of the carbon atoms in the main chain of the alkylene group may be replaced with O, S, NH, or $NR^{19}$, $R^{19}$ representing an alkyl group, β represents a phenylene group, a phenylene group substituted with an alkyl group having 1 to 6 carbon atoms, a phenylene group substituted with a nitro group, a phenylene group substituted with a halogen atom, or a phenylene group substituted with a alkoxy group and may have at least one substituent selected from the group consisting of a hydroxy group, a thiol group, an amino group, and a carboxyl group, and γ represents a hydrogen atom, an alkyl group having 1 to 6 main-chain atoms, or an alkyl group having 1 to 6 main-chain atoms and substituted with an alkyl group having 1 to 6 carbon atoms and may have at least one substituent selected from the group consisting of a hydroxy group, a thiol group, an amino group, and a carboxyl group.

2. The electrophotographic photosensitive member according to claim 1, wherein, in formula (A), α represents the alkylene group having 1 to 6 main-chain atoms, the alkylene group having 1 to 6 main-chain atoms and substituted with the alkyl group having 1 to 6 carbon atoms, the alkylene group having 1 to 6 main-chain atoms and substituted with the benzyl group, the alkylene group having 1 to 6 main-chain atoms and substituted with the alkoxycarbonyl group, or the alkylene group having 1 to 6 main-chain atoms and substituted with the phenyl group, one of the carbon atoms in the main chain of the alkylene group may be replaced with O, NH, or $NR^{19}$, $R^{19}$ representing an alkyl group.

3. The electrophotographic photosensitive member according to claim 1, wherein the isocyanate compound has a cyclic structure.

4. The electrophotographic photosensitive member according to claim 3, wherein the cyclic structure is an isocyanurate structure.

5. The electrophotographic photosensitive member according to claim 1, wherein the resin having a repeating structural unit represented by formula (B) is a polyvinyl acetal resin.

6. The electrophotographic photosensitive member according to claim 1, wherein the molecular weight of the electron transporting substance is 150 to 1000.

7. The electrophotographic photosensitive member according to claim 1, wherein the ratio of the isocyanate compound to the electron transporting substance is 3/20 to 50/20 by the molecular weight.

8. A method for producing the electrophotographic photosensitive member according to claim 1, the method comprising the steps of:

forming a coating film by using a coating solution for forming an undercoat layer, the coating solution containing the composition; and heat-drying the coating film to form the undercoat layer.

9. A process cartridge detachably attachable to a main body of an electrophotographic apparatus, the process cartridge comprising:

the electrophotographic photosensitive member according to claim 1; and at least one device selected from the group consisting of a charging device, a developing device, a transferring device, and a cleaning device, wherein the electrophotographic photosensitive member and the at least one device are integrally supported.

10. An electrophotographic apparatus comprising:

the electrophotographic photosensitive member according to claim 1;

a charging device;

an exposure device;

a developing device; and a transferring device.

11. An imide compound represented by formula (21) or (22) below (21)

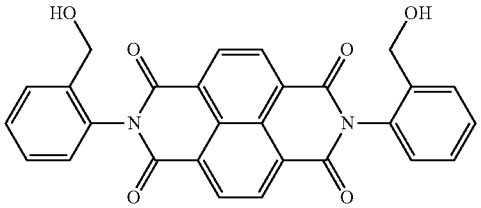

(22)

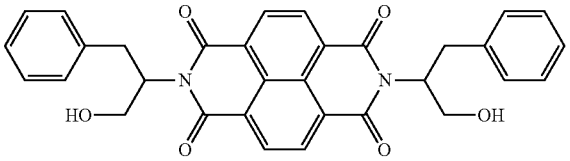

12. An imide compound represented by formula (23) or (24) below (23)

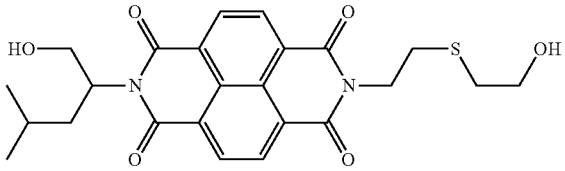

(24)

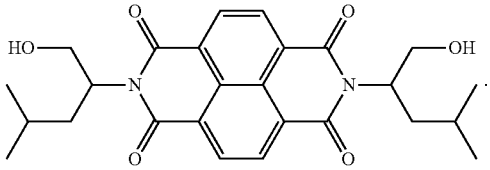

* * * * *